US006937224B1

(12) United States Patent
Miyachi

(10) Patent No.: US 6,937,224 B1
(45) Date of Patent: Aug. 30, 2005

(54) LIQUID CRYSTAL DISPLAY METHOD AND LIQUID CRYSTAL DISPLAY DEVICE IMPROVING MOTION PICTURE DISPLAY GRADE

(75) Inventor: Koichi Miyachi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 327 days.

(21) Appl. No.: 09/595,363

(22) Filed: Jun. 15, 2000

(30) Foreign Application Priority Data

Jun. 15, 1999 (JP) ..... 11-168152
Apr. 26, 2000 (JP) ..... 2000-125910

(51) Int. Cl.[7] ..... G09G 3/36
(52) U.S. Cl. ..... 345/102; 345/99; 345/100
(58) Field of Search ..... 345/87, 98–100, 345/102–104, 204, 214

(56) References Cited

U.S. PATENT DOCUMENTS

| | | | | |
|---|---|---|---|---|
| 4,655,550 A | | 4/1987 | Crossland et al. | 350/332 |
| 4,778,260 A | | 10/1988 | Okada et al. | 350/350 S |
| 5,627,560 A | | 5/1997 | Verhulst | 345/97 |
| 5,844,534 A | * | 12/1998 | Okumura et al. | 345/90 |
| 6,115,017 A | * | 9/2000 | Mikami et al. | 345/92 |
| 6,396,469 B1 | | 5/2002 | Miwa et al. | 345/87 |
| 6,473,077 B1 | | 10/2002 | Takenaka et al. | 345/209 |

FOREIGN PATENT DOCUMENTS

| | | |
|---|---|---|
| EP | 0 655 725 A1 | 5/1995 |
| EP | 0 730 371 A2 | 9/1996 |
| JP | 04-309995 | 11/1992 |
| JP | 07-140933 | 6/1995 |
| JP | 11-109921 | 4/1999 |
| WO | WO 95/01701 | 1/1995 |
| WO | WO 97/31362 | 8/1997 |

OTHER PUBLICATIONS

"A New Motion-Picture Compatible LCD Using Pi-Cells", Journal of the Japan Society of Liquid Crystals, 1999, vol. 3, No. 2, pp. 99-106.

* cited by examiner

*Primary Examiner*—Jimmy H. Nguyen
(74) *Attorney, Agent, or Firm*—David G. Conlin; David A. Tucker; Edwards & Angell, LLP

(57) ABSTRACT

A source driver outputs a data signal and a reset (black) signal alternately to a source line. Four-hundred and eighty gate lines are divided into three groups each comprising 160 lines, and connected to gate drivers. A display control section outputs a discriminant signal, a scan start signal and a clock signal to the gate drivers, where the nth gate line is selected with the data signal outputted by the source driver, and where the (n+160)th gate line is selected with the reset signal outputted. Further, n is shifted sequentially. By writing the reset signal during the latter ⅓ of one frame like this, light leakage of pixels that are changed over from white display to black display is eliminated. Also, blurs of edge portions of a motion picture are reduced. Thus, display grade for motion pictures is enhanced with a minimum improvement.

12 Claims, 19 Drawing Sheets

Fig.10
PRIOR ART
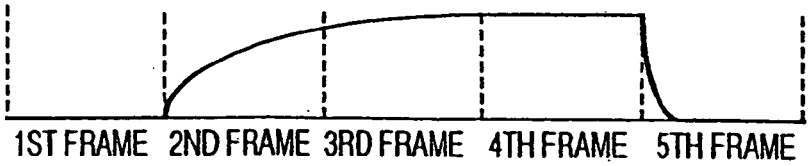
Fig.11A
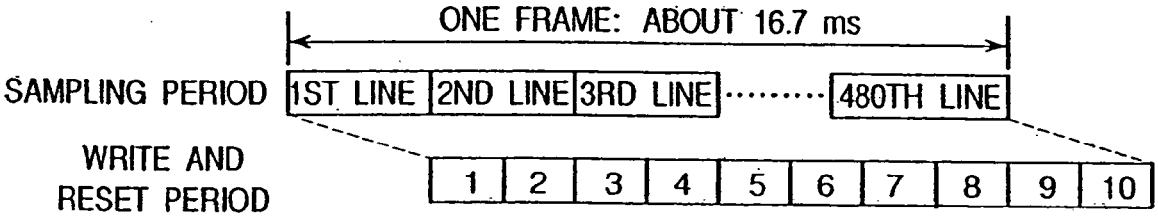
Fig.11B
| NO. | STATE OF DRIVE |
|---|---|
| 1 | 1ST LINE, DATA SIGNAL WRITE |
| 2 | 161ST LINE, RESET SIGNAL WRITE |
| 3 | 2ND LINE, DATA SIGNAL WRITE |
| 4 | 162ND LINE, RESET SIGNAL WRITE |
| 5 | 3RD LINE, DATA SIGNAL WRITE |
| 6 | 163RD LINE, RESET SIGNAL WRITE |
| 7 | nTH LINE, DATA SIGNAL WRITE |
| 8 | (160+n)TH LINE, RESET SIGNAL WRITE |
| 9 | 480TH LINE, DATA SIGNAL WRITE |
| 10 | 160TH LINE, RESET SIGNAL WRITE |

Fig.27A
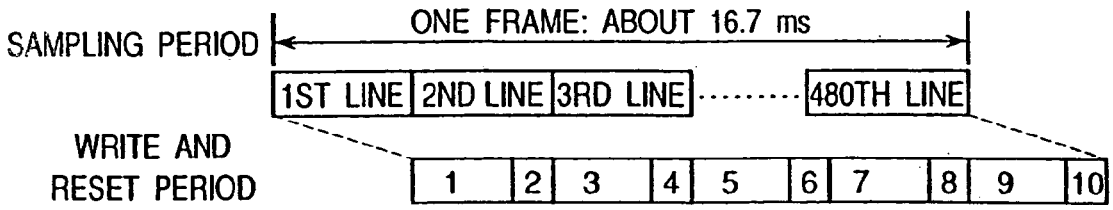
Fig.27B
| NO. | STATE OF DRIVE |
|---|---|
| 1 | 1ST LINE, DATA SIGNAL WRITE |
| 2 | 257~260TH LINE, RESET SIGNAL WRITE |
| 3 | 2ND LINE, DATA SIGNAL WRITE |
| 4 | 258~261ST LINE, RESET SIGNAL WRITE |
| 5 | 3RD LINE, DATA SIGNAL WRITE |
| 6 | 259~262ND LINE, RESET SIGNAL WRITE |
| 7 | nTH LINE, DATA SIGNAL WRITE |
| 8 | (256+n)~(259+n)TH LINE, RESET SIGNAL WRITE |
| 9 | 1024TH LINE, DATA SIGNAL WRITE |
| 10 | 256~259TH LINE, RESET SIGNAL WRITE |
Fig.28
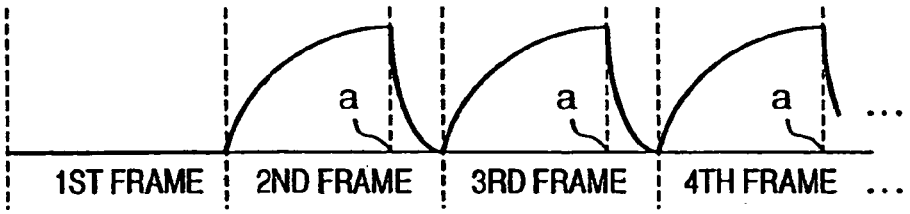

| NO. | STATE OF DRIVE |
|---|---|
| 1 | 1ST LINE, DATA SIGNAL WRITE |
| 2 | 257,513RD LINE, RESET SIGNAL WRITE |
| 3 | 2ND LINE, DATA SIGNAL WRITE |
| 4 | 258,514TH LINE, RESET SIGNAL WRITE |
| 5 | 3RD LINE, DATA SIGNAL WRITE |
| 6 | 259,515TH LINE, RESET SIGNAL WRITE |
| 7 | nTH LINE, DATA SIGNAL WRITE |
| 8 | (256+n),(512+n)TH LINE, RESET SIGNAL WRITE |
| 9 | 480TH LINE, DATA SIGNAL WRITE |
| 10 | 256,512TH LINE, RESET SIGNAL WRITE |

LIQUID CRYSTAL DISPLAY METHOD AND LIQUID CRYSTAL DISPLAY DEVICE IMPROVING MOTION PICTURE DISPLAY GRADE

BACKGROUND OF THE INVENTION

The present invention relates to a liquid crystal display method and a liquid crystal display device which are superior in motion picture display.

Hitherto, there has been available an active matrix type LCD (Liquid Crystal Display) device. In this active matrix type LCD device, as shown in FIG. 31, each time one-horizontal-line data is sampled from an image signal to a sampling memory 2 by a source driver 1, the sampled data is stored into a holding memory 3. On the liquid crystal panel side, a horizontal line made up of a row of pixels into which data is to be written is selected by a gate driver (not shown), and TFTs (Thin Film Transistors) of the selected pixels are turned on. Then, the one-horizontal-line data signal stored in the holding memory 3 is converted from digital to analog form by a D/A converter 4 and written as such via a source line 6 into all the pixels constituting the selected horizontal line.

This operation is executed for all the horizontal lines, by which image writing for one screen is completed. Further, repeating this image writing for one frame enables a wide variety of images to be displayed. Active matrix type LCD devices which perform such display operations have been finding applications for display sections of word processors and notebook personal computers, or for televisions.

In the conventional active matrix type LCD device as described above, since the response speed of liquid crystals, particularly response speed among halftones, is slower than 16.7 ms, which is the one-frame period, there has been a problem of display grade deterioration that afterimages may be seen in motion picture display.

Also, the data signal written into corresponding pixels continues being held while TFTs keep unselected. For this reason, even if the response speed of liquid crystals is increased, there exists an afterimage on the retina due to human eyes' tracing the motion picture. As a result, the display grade deteriorates as another problem.

Under these circumstances, in order to solve the above problems, there has been proposed a liquid crystal display method as shown below (References 1 and 2). In Reference 1, "Japanese Patent Laid-Open Publication HEI 11-109921," the screen is divided into upper and lower two divisions, and in the first half of the frame period, signal scan for the upper screen is performed while black signal (blanking) scan for the lower screen is performed. In the second half of the frame period, black signal (blanking) scan for the upper screen is performed while signal scan for the lower screen is performed.

In Reference 2, "A New Motion-Picture Compatible LCD Using Pi-Cells, Journal of the Japan Society of Liquid Crystals, 1999, vol. 3, No. 2," the screen is divided into upper and lower two divisions, and besides the one frame period is divided into time slots corresponding to the number of lines of the whole screen. Then, in the first slot, signal scan for the upper screen is performed while signal scan also for the lower screen is performed simultaneously. In the second slot, black signal (blanking) scan for the upper screen is performed while black signal (blanking) scan also for the lower screen is performed simultaneously. In this way, signal scan and black signal (blanking) scan are iterated sequentially from slot to slot.

According to the above liquid crystal display methods, with regard to one pixel, both image display period and black display period are necessarily included in one frame period, where, in particular, the presence of the black display period makes it possible to achieve image display free from any mixed presence of preceding- and succeeding-frame data. Thus, an improvement in the display performance for motion pictures can be achieved.

However, the liquid crystal display method disclosed in Reference 2 has the following problem. That is, the one frame period is divided into time slots corresponding to the number of lines of the whole screen, and further the screen is divide into upper and lower two divisions. Then, in the first slot, signal scan for the upper screen is performed while signal scan also for the lower screen is performed simultaneously. In the second slot, black signal (blanking) scan for the upper screen is performed while black signal (blanking) scan also for the lower screen is performed simultaneously. In this way, signal scan and black signal (blanking) scan are iterated sequentially from slot to slot. Therefore, when the upper screen starts to be scanned, the lower screen also needs to be scanned simultaneously, making it necessary to once store one-line image data. As a result, the circuitry is complicated, leading to a cost increase, as a problem.

The liquid crystal display method disclosed in Reference 1 has a similar problem. That is, one frame period is divided into first and second halves, and besides the screen is divided into upper and lower two divisions. Then, in the first half of the one frame period, signal scan for the upper screen is performed while black signal (blanking) scan for the lower screen is performed simultaneously. In the second half of the one frame period, black signal (blanking) scan for the upper screen is performed while signal scan for the lower screen is performed simultaneously. In this case, although the storage of image data as in Reference 2 is unnecessary, there still arise disadvantages of complicated circuitry and cost increase due to the screen division.

Needless to say, dividing the screen would give rise to a need for, for example, a double of source drivers, upper and lower, which leads to a cost increase.

Therefore, an object of the present invention is to provide a liquid crystal display method, as well as a liquid crystal display device, which are capable of improving the motion picture display grade by a minimum essential improvement of conventional LCD devices without performing such screen division as in References 1 and 2 and without requiring any special screen storage devices.

In order to achieve the object, there is provided a liquid crystal display method for displaying an image to pixels by supplying a data signal to a plurality of column lines arrayed in parallel to one another and by supplying a select signal to a plurality of row lines arrayed in parallel to one another in a direction in which the row lines intersect the column lines, the pixels to which the image is displayed being made up of liquid crystals located at intersecting points, or vicinities of the intersecting points, between the column lines to which the data signal is supplied and the row lines to which the select signal is supplied, the liquid crystal display method comprising:

a step for supplying the select signal to the nth (where n is a positive integer) row line and also supplying the data signal to the column lines, thereby displaying an image based on the data signal to pixels located at intersecting points between the nth row line and the individual column lines;

a step for next supplying the select signal to the (n+m)th row line, where "m" is a positive integer, and also supplying to the column lines a black display signal for displaying a black image to pixels, thereby displaying the black image to pixels located at intersecting points between the (n+m)th row line and the individual column lines;

a step for iterating the image display operation based on the data signal and the black image display operation while sequentially shifting the row line to which the select signal is supplied; and a step for, with a return to the first row line if the (n+m)th row line, to which the select signal is supplied, is beyond the last row line, displaying the image based on the data signal and the black image to all the pixels within one frame period.

With this constitution, unlike References 1 and 2, data signal supply and black display signal supply to the column lines are alternately performed, where the row line to which the select signal is supplied is shifted with n increased as n, n+m, n+1, n+m+1, n+2, n+m+2, . . . , synchronized with the supply of data signal and black display signal. Thus, without dividing the screen or without using a circuit for storing one-screen image data, the data signal is written into all the pixels, and the black display signal is supplied thereto after an elapse of a specified time period corresponding to "m," and further the state that the black display signal has been written is held until a new image data signal is written for the next frame, by which a black image is displayed. Therefore, in the case where a pixel under white display changes over to black display at the next frame, the black image has already been displayed when the black display signal is written. Thus, there occurs no light leakage of backlight.

Also, an image edge in a motion picture moves at a change of frames and keeps halted during the frame period. However, since the image is felt smoothly moving to humans, there are one period in which the image edge is present forward of the human line of sight and another period in which the image edge is present backward, so that the image edge looks blurred. However, in this invention, since the pixels under image display turn to a black display and disappear before the next data signal is applied, the period in which the image edge is present forward of the human line of sight and another period in which the image edge is present backward resultantly become shorter so that the blur of the image edge is reduced. Thus, the motion picture display grade is improved.

Also, there is provided a liquid crystal display method for displaying an image to pixels by supplying a data signal to a plurality of column lines arrayed in parallel to one another and by supplying a select signal to a plurality of row lines arrayed in parallel to one another in a direction in which the row lines intersect the column lines, the pixels to which the image is displayed being made up of liquid crystals located at intersecting points, or vicinities of the intersecting points, between the column lines to which the data signal is supplied and the row lines to which the select signal is supplied, the liquid crystal display method comprising:

a step for supplying the select signal to the nth row line (where n is a positive integer) and also supplying the data signal to the column lines, thereby displaying an image based on the data signal to pixels located at intersecting points between the nth row line and the individual column lines;

a step for next supplying the select signal simultaneously to a plurality of row lines other than the nth row line, and also supplying to the column lines a black display signal for displaying a black image to pixels, thereby displaying the black image to pixels located at intersecting points between the plurality of row lines and the individual column lines;

a step for iterating the image display operation based on the data signal and the black image display operation while sequentially shifting the row line to which the select signal is supplied; and a step for, with a return to the first row line if the plurality of row lines, to which the select signal is simultaneously supplied, are beyond the last row line, displaying the image based on the data signal and the black image to all the pixels within one frame period.

With this constitution, the black display signal is supplied a plurality of times to all the pixels in the second half of one frame period. Accordingly, even if the black display signal supply time is such that enough black image display cannot be achieved only by one-time supply of the black display signal, the black display can be securely achieved by the supply of the black display signal being iterated a plurality of times. Thus, even if the black display signal supply time is insufficient because of a large number of row lines due to high pixel density of the display panel, a high-grade motion picture display free from occurrence of light leakage of the backlight can be achieved.

In one embodiment of the present invention, the plurality of row lines are $(n+\alpha\cdot m)$th ($\alpha$=1, 2, . . . , p (where p is a positive integer)) lines.

With this constitution, with regard to one horizontal line, black display is executed iteratively every m-line scans. Thus, the effect of the display contents of the preceding frame on the dielectric characteristics of liquid crystals is eliminated, so that a further higher display grade can be achieved.

In one embodiment of the present invention, the plurality of row lines are $(n+\alpha\cdot m)$th to $(n+\alpha\cdot m+k-1)$th ($\alpha$= 1, 2, . . . , p (where p and k are positive integers)) lines.

With this constitution, with regard to one horizontal line, black display is executed iteratively k times every m-line scans. Thus, the effect of the display contents of the preceding frame is further eliminated.

In one embodiment of the present invention, supply time of the data signal and supply time of the black display signal are equal to each other.

With this constitution, since the supply time of the data signal and the supply time of the black display signal are equal to each other, the supply of the data signal and the supply of the black display signal are switched over by a very simple switching control process.

In one embodiment of the present invention, supply time of the data signal is longer than supply time of the black display signal.

With this constitution, the liquid crystal display method is ready also for such cases where enough data signal supply time cannot be taken because of a large number of row lines due to high pixel density of the display panel.

In one embodiment of the present invention, value of the m is set so as to satisfy the following relationship:

$$f\times m/N>t$$

where

N is the number of row lines, f is the one frame period, and t is response time of liquid crystals at a switch from white display to black display.

With this constitution, the black display signal supply time in one frame period is set to a time period longer than the response time of liquid crystals which results when white display is switched to black display. Thus, even in pixels on which a white image is displayed based on the data signal, black display is securely executed before the next data signal is applied.

In one embodiment of the present invention, value of the k is set so as to satisfy the following relationship:

$$T \times k \geqq T_0$$

Where

T is one-time supply time of the black display signal, and $T_0$ is the shortest time of the black display signal that allows white display to be completely changed over to black display.

With this constitution, the supply time of the black display signal in one frame period is set to a time period longer than the shortest time that allows white display to be switched to black display by k-time supply of the black display signal. Thus, in the case where the black display signal is supplied iteratively k times because of an insufficient supply time of the black display signal, black display is securely executed before the next data signal is applied, even in pixels on which a white image is displayed based on the data signal.

In one embodiment of the present invention, a voltage Vd for a case where the data signal is a data signal for black display and a voltage Vr of the black display signal are set so as to satisfy the following relationship:

for positive polarity with respect to a potential level of a counter electrode,

Vd<Vr in normally white mode, and

Vd>Vr in normally black mode; and for negative polarity to the potential level of the counter electrode, Vd>Vr in the normally white mode, and Vd<Vr in the normal black mode.

With this constitution, even when enough black display cannot be executed because of an insufficient supply time of the black display signal, black display is securely executable by preparatorily setting the voltage for the black display signal to a somewhat larger (small) one.

Also, there is provided a liquid crystal display device having: a display panel in which are formed at least a plurality of column lines arrayed in parallel to one another, a plurality of row lines arrayed in parallel to one another in a direction in which the row lines intersect the column lines, and pixels made up of liquid crystals located at intersecting points, or vicinities of the intersecting points, between the column lines and the row lines; a column line driver for supplying a data signal to the column lines; and a row line driver for supplying a select signal to the row lines, the liquid crystal display device comprising:

a display control section for supplying an image signal and a control signal to the column line driver, while supplying a control signal to the row line driver, thereby controlling image display operation to the display panel;

black display signal generating means for generating a black display signal to thereby display a black image to the pixels; and a selector switch provided in the column line driver and operative for switchedly selecting alternately between a data signal based on an image signal derived from the display control section and a black display signal derived from the black display signal generating means, wherein the display control section supplies to the row line driver the control signal for making the row lines sequentially selected, where the select signal is supplied to the nth row line while the data signal is selected by the selector switch, and where the select signal is supplied to the (n+m) row line while the black display signal is selected by the selector switch.

With this constitution, based on the control signal from the display control section, the row line driver and the column line driver are controlled as follows. When the data signal is selected by the selector switch for the column line driver and supplied to column lines, the nth row line is selected by the row line driver. Meanwhile, when the black display signal is selected by the selector switch and supplied to column lines, the (n+m)th row line is selected. Thus, the data signal is written into all the pixels, and after an elapse of a specified time period corresponding to "m," the black display signal is supplied, and further the state that the black display signal has been written is held until a new image data signal is written for the next frame, by which a black image is displayed. Therefore, in the case where a pixel under white display changes over to black display at the next frame, the black image has already been displayed when the black display signal is written. Thus, there occurs no light leakage of backlight.

Also, there is provided a liquid crystal display device having: a display panel in which are formed at least a plurality of column lines arrayed in parallel to one another, a plurality of row lines arrayed in parallel to one another in a direction in which the row lines intersect the column lines, and pixels made up of liquid crystals located at intersecting points, or vicinities of the intersecting points, between the column lines and the row lines; a column line driver for supplying a data signal to the column lines; and a row line driver for supplying a select signal to the row lines, the liquid crystal display device comprising:

a display control section for supplying an image signal and a control signal to the column line driver, while supplying a control signal to the row line driver, thereby controlling image display operation to the display panel;

black display signal generating means for generating a black display signal to thereby display a black image to the pixels; and a selector switch provided in the column line driver and operative for switchedly selecting alternately between a data signal based on an image signal derived from the display control section and a black display signal derived from the black display signal generating means, wherein the display control section supplies to the row line driver the control signal for making the row lines sequentially selected, where the select signal is supplied to the nth row line while the data signal is selected by the selector switch, and where the select signal is supplied to a plurality of row lines other than the nth row line while the black display signal is selected by the selector switch.

With this constitution, based on the control signal from the display control section, the row line driver and the column line driver are controlled as follows. When the data signal is selected by the selector switch for the column line driver and supplied to column lines, the nth row line is selected by the row line driver. Meanwhile, when the black display signal is selected by the selector switch and supplied to column lines, a plurality of row lines other than the nth line are selected. Accordingly, even if the black display signal supply time is such that enough black image display cannot be achieved only by one-time supply of the black display signal, the black display can be securely achieved by the supply of the black display signal being iterated a plurality of times. Thus, even if the black display signal supply time is insufficient because of a large number of row lines due to high pixel density of the display panel, a high-grade motion picture display free from occurrence of light leakage of the backlight can be achieved.

In one embodiment of the present invention, the row lines are divided into L (where L is a positive integer) blocks on an m-line basis;

the row line driver comprises L partial row line drivers for supplying a select signal to row lines of each block.

With this constitution, when the data signal is supplied to a column line by the selector switch, the nth row line connected to one partial row line driver is selected by the one partial row line driver. Meanwhile, when the black display signal is supplied to a column line by the selector switch, the nth row line connected to one partial row line driver located at the just rear column of the partial row line driver is selected by the partial row line driver. Thus, the selection operation of (n+m) row lines can be achieved by simple control.

In one embodiment of the present invention, the control signal from the display control section to the column line driver includes a switching control signal for controlling switching operation performed by the selector switch; and the switching control signal makes select time of the data signal longer than select time of the black display signal.

With this constitution, the supply time of the data signal is longer than the supply time of the black display signal. Therefore, the liquid crystal display device is ready also for such cases where enough data signal supply time cannot be taken because of a large number of row lines due to high pixel density of the display panel.

In one embodiment of the present invention, the control signal from the display control section to the column line driver includes a switching control signal for controlling switching operation performed by the selector switch; and the switching control signal makes select time of the data signal and select time of the black display signal equal to each other.

With this constitution, since the supply time of the data signal and the supply time of the black display signal are equal to each other, the supply of the data signal and the supply of the black display signal are changed over by a very simple switching control process.

In one embodiment of the present invention, the control signal from the display control section to the row line driver includes a discriminant signal for discriminating whether it is a black display signal supply period during which the black display signal is supplied; and based on the discriminant signal, the row line driver supplies the select signal to the (n+m)th to (n+m+k− 1)th row lines during the black display signal supply period.

With this constitution, the black display signal is supplied to all the pixels k times during a specified time period corresponding to "m" before the next data signal is applied. Accordingly, even if the black display signal supply time corresponding to the "m" is insufficient to fulfill black image display, the black display can be securely achieved by the supply of the black display signal being iterated k times. Thus, even if enough black display signal supply time cannot be taken because of a large number of row lines due to high pixel density of the display panel, a high-grade motion picture display free from occurrence of light leakage of the backlight can be achieved.

In one embodiment of the present invention, the control signal from the display control section to the row line driver includes a scan start signal, and wherein the row line driver comprise:

a shift register having a plurality of latch circuits; and scan start signal supplying means for supplying the scan start signal to the first latch circuit of the shift register during a data signal supply period, and also supplying the scan start signal to continuous k latch circuits starting from the mth latch circuit of the shift register during a black display signal supply period.

With this constitution, a row line driver capable of supplying the black display signal k times before the next data signal is applied can be realized with a simple construction that the row line driver having a shift register is equipped with the scan start signal supplying means.

In one embodiment of the present invention, the scan start signal supplying means is enabled to change the latch circuit number "m" and the number of latch circuits "k" for the black display signal supply period.

With this constitution, by the latch circuit number "m" being changed, the time at which the black image is displayed is changed before the next data signal is applied. Besides, by the latch circuit count "k" being changed, the number of times the black display signal is supplied is changed before the next data signal is applied.

In one embodiment of the present invention, a liquid crystal display device further comprises:

supply control means for controlling operation of the scan start signal supplying means, and the supply control means outputs a control signal for setting the latch circuit number "m" to the scan start signal supplying means based on a scan-start-position designating signal from external.

With this constitution, based on the signal from external, the time at which the black image is displayed is changed before the next data signal is applied.

In one embodiment of the present invention, the display control section, in response to a command signal from external, selectively outputs a control signal for a first display mode in which a black display signal supply operation based on an operation performed by the selector switch is performed, or a control signal for a second display mode in which a black display signal supply operation is not performed with the selector switch out of operation.

With this constitution, the display mode is switched between the first display mode that involves increased energy consumption because the black display signal is supplied to column lines and the second display mode that involves less energy consumption based on operation of the selector switch frame by frame. Thus, waste of energy resulting when the display mode is normally fixed to the first mode is prevented.

In one embodiment of the present invention, a liquid crystal display device further comprises:

a signal-use reference power supply for setting a voltage of a data signal supplied from the column line driver, wherein the voltage of the signal-use reference power supply is changeable between the first display mode and the second display mode.

With this constitution, in the first display mode in which the black display signal is supplied after the write of the data signal and the black image is displayed before the write of a new image data signal for the next frame so that the transmissivity of liquid crystals is lowered, the voltage of the signal-use reference power supply is changed over so that the voltage of the data signal is set in response to the lowering of the liquid-crystal transmissivity. Thus, a constant gray-level balance is maintained between the first display mode and the second display mode.

In one embodiment of the present invention, a liquid crystal display device further comprises:

motion picture/still picture discriminating means for monitoring data of the same position on a screen based on an image signal derived from the display control section, thereby discriminating whether a picture based on the image signal is a motion picture or a still picture, and outputting the command signal representing a result of the discrimination to the display control section.

With this constitution, whether or not a picture is a motion picture or a still picture is discriminated based on the image signal by the motion picture/still picture discriminating means, and a command signal representing the discrimination result is outputted to the display control section. Thus, for a motion picture display, in which the display grade is liable to deteriorate, a control signal for the first display mode is automatically outputted from the display control section, and the black image is displayed after the write of the data signal during one frame period and before the application of the data signal for the next frame. Thus, the display grade is improved.

In one embodiment of the present invention, a liquid crystal display device further comprises:

a backlight for illuminating the display panel from its rear side; and backlight adjusting means for switching brightness of the backlight between the first display mode and the second display mode according to the command signal.

With this constitution, during one frame period, in the first display mode in which the black image is displayed after the write of the data signal and until the application of the data signal for the next frame so that the transmissivity of liquid crystals is lowered, the brightness of the backlight is increased by the backlight adjusting means. In the normal second display mode, the brightness of the backlight declines. Thus, waste of energy resulting when the brightness of the backlight is kept normally higher is prevented.

In one embodiment of the present invention, the black display signal generating means is a black display signal use power supply, and voltage of the black display signal power supply is changeable between the first display mode and the second display mode.

With this constitution, during one frame period, in the first display mode in which the black image is displayed after the write of the data signal and until the application of the data signal for the next frame, the voltage of the black display signal power supply is changed over so that black display is securely achieved.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 is a view showing a frame-by-frame transmissivity variation in white-band pixels based on the image display sequence of the prior art;

FIG. 11A is a view showing an image display sequence in the LCD device shown in FIG. 1;

FIG. 11B is a view showing details of write and reset periods in FIG. 11A;

FIG. 27A is a view showing an image display sequence other than those of FIG. 11 and FIG. 24;

FIG. 27B is a view showing details of write and reset periods in FIG. 27A;

FIG. 28 is a view showing a frame-by-frame transmissivity variation based on the image display sequence shown in FIG. 27;

DETAILED DESCRIPTION OF THE PREFERRED EMBODIMENTS

Hereinbelow, the present invention is described in detail by way of embodiments thereof illustrated in the accompanying drawings.

First Embodiment

Figure 1:
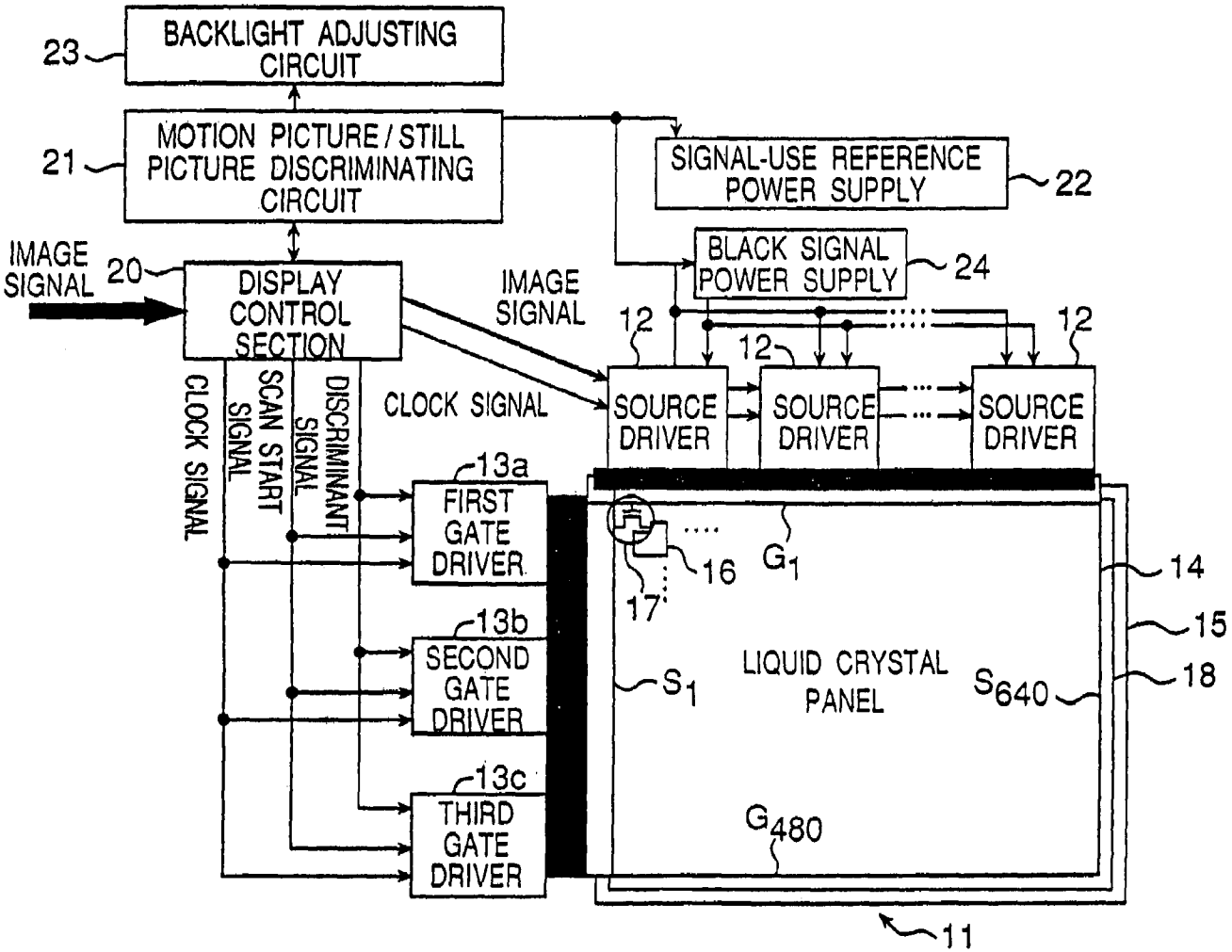
FIG. 1 is a schematic block diagram of an LCD device according to the present invention.

FIG. 1 is a schematic block diagram of an active matrix type LCD device as an LCD device of this embodiment. The LCD device of this embodiment has a liquid crystal panel 11, a plurality of source drivers 12 and a plurality of gate drivers 13. The liquid crystal panel 11 has a TFT substrate 14 and a counter substrate 15. On the TFT substrate 14, are formed pixel electrodes 16 arrayed in a matrix shape, TFTs 17 the drains of which are connected to the pixel electrodes 16, gate lines G connected commonly to gates of the TFTs 17 of each row and arrayed in parallel, and source lines S connected commonly to sources of the TFTs 17 of each column and arrayed in parallel. On the counter substrate 15 opposed to the TFT substrate 14 with a specified spacing, counter electrodes 18 are formed opposite to the pixel electrodes 16. Also, although not shown, liquid crystals are sandwiched between the pixel electrodes 16 and the counter electrodes 18.

The liquid crystal panel 11 of this embodiment employs a VGA (Video Graphics Array) panel having 480 gate lines G, 640 (tripled for color display) source lines S. The 480 gate lines G are divided into three groups each comprising 160 lines, and connected to first gate driver 13*a*–third gate driver 13*c* on the group basis. Similarly, the source lines S are divided into a plurality of groups and connected to the source drivers 12 on the group basis.

A display control section 20 has means for generating a clock signal, and outputs the generated clock signal together with an inputted image signal to the first source driver 12. The display control section 20 also has means for generating a scan start signal and means for generating a discriminant signal, and outputs the generated scan start signal and discriminant signal together with a clock signal to the gate drivers 13. A motion picture/still picture discriminating circuit 21 discriminates whether a picture is a motion picture composed mainly of dynamic image or a still picture composed mainly of static image, based on the image signal received from the display control section 20, by monitoring data of several points on the screen. Then, the motion picture/still picture discriminating circuit 21 returns the discrimination result to the display control section 20. Responsively, the display control section 20 switches a switching clock signal, which is one of the aforementioned clock signals, the discriminant signal and the scan start signal, to either motion picture use or still picture use, based on the discrimination result.

Further, the discrimination result derived from the motion picture/still picture discriminating circuit 21 is outputted also to a signal-use reference power supply 22, a black-signal use power supply 24 and a backlight adjusting circuit 23. Then, the signal-use reference power supply 22 and the black-signal use power supply 24 transmit a data-signal reference voltage and a black-signal voltage responsive to the discrimination result to the source drivers 12. Also, the backlight adjusting circuit 23 adjusts the backlight (not shown) in response to the discrimination result. It is noted that the black signal power supply 24 is a power supply to be used for the generation of a reset signal (black signal) which will be detailed later.

Figure 2:
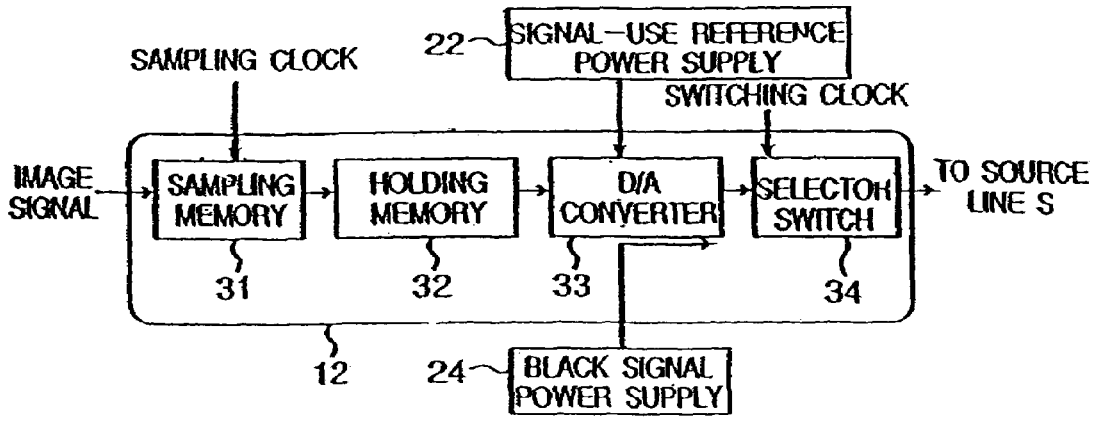
FIG. 2 is a schematic block diagram of a source driver in FIG. 1.

FIG. 2 is a schematic block diagram of the source driver 12. Although one source line S is typically shown in this figure, those of similar constitution are provided for all the source lines S. Data corresponding to one pixel (one horizontal line) is sampled from an image signal to a sampling memory 31, and the sampled data is stored into a holding memory 32. Then, the data is converted from digital to analog form by a D/A converter 33 by using a signal-use reference voltage derived from the signal-use reference power supply 22, and transmitted as such to a selector switch 34.

Inputted to this selector switch 34 are clock signals which result from dividing a sampling clock signal supplied to the sampling memory 31, the holding memory 32 and the D/A converter 33, and which are the switching clock signals whose cycle is given by a time period over which data of one horizontal line is sampled to the sampling memories 31, 31, . . . of all the source drivers 12, 12, . . . . Then, when the switching clock signal is at, for example, "H" level, the selector switch 34 selects a data signal derived from the D/A converter 33 and outputs the signal to the corresponding source line S. When the switching clock signal is at "L" level, the selector switch 34 selects a black signal voltage derived from the black signal power supply 24 and outputs the signal to the corresponding source line S as the reset signal.

Figure 3:
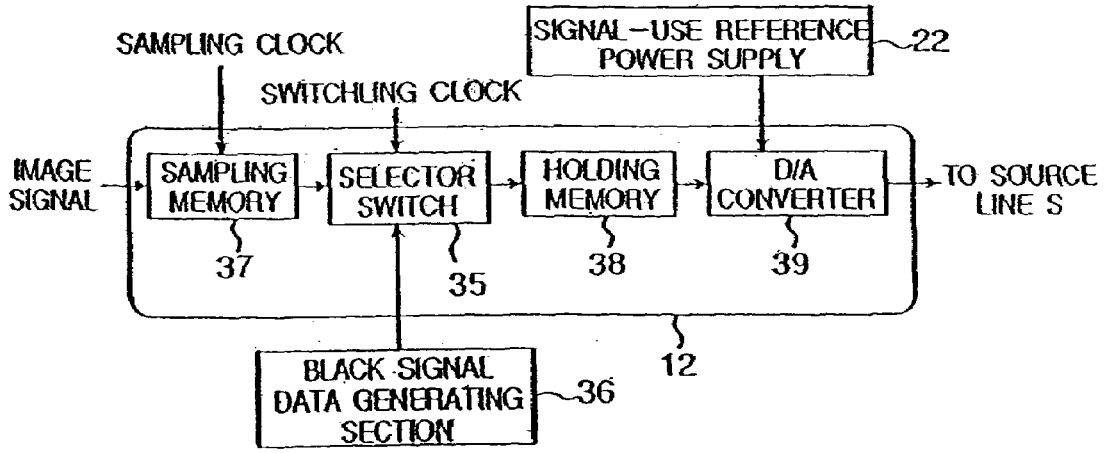
FIG. 3 is a schematic block diagram of a source driver other than that of FIG. 2.

Alternatively, the source driver 12 may be constituted as shown in FIG. 3 without any problem. More specifically, whereas the selector switch 34 is placed at the succeeding stage of the D/A converter 33 in the source driver 12 shown in FIG. 2, a selector switch 35 is placed at the preceding stage of a holding memory 38 in FIG. 3. Then, when the switching clock signal is at, for example, "H" level, the selector switch 35 selects an image signal derived from a sampling memory 37 and outputs the signal to the holding memory 38. When the switching clock signal is at "L" level, the selector switch 35 selects black signal data derived from a black signal data generating section 36 and transmits the data to the holding memory 38. Then, the signal is converted from digital to analog form by a D/A converter 39 with a signal-use reference voltage derived from the signal-use reference power supply 22, and outputted as such to the corresponding source line S. Thus, the data signal based on the image signal is outputted to the source line S in the first half of the time period over which one horizontal line data is sampled, and the reset signal based on the black signal data is outputted to the source line S in the second half.

Figure 4:
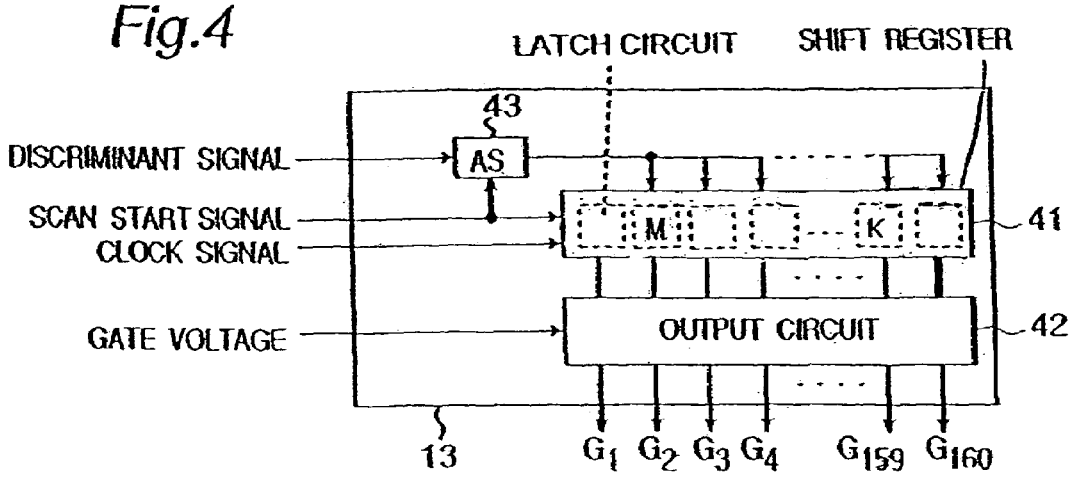
FIG. 4 is a schematic block diagram of a gate driver in FIG. 1.

FIG. 4 is a schematic block diagram of the gate driver 13. The constitution of the gate driver 13 in the present invention is not limited to this. The gate driver 13 of this embodiment has a shift register 41, an output signals from latch circuits (shown representatively in phantom) constituting this shift register 41 are supplied to an output circuit 42. Then, a gate voltage of "H" level or "L" level is applied to a gate line G by the output circuit 42, by which the gate line G is selected.

The shift register 41 shifts a scan start signal supplied to the first latch circuit to the succeeding latch circuits sequentially based on the clock signal from the display control section 20, thereby sequentially selecting gate lines G. In this case, the scan start signal is inputted also to an analog switch 43 which opens and closes according to a control signal given by the discriminant signal derived from the display control section 20. When the discriminant signal goes, for example, "H" level, the analog switch 43 is opened so that the scan start signal is supplied also to the second to fourth latch circuits in the shift register 41.

Figure 5:
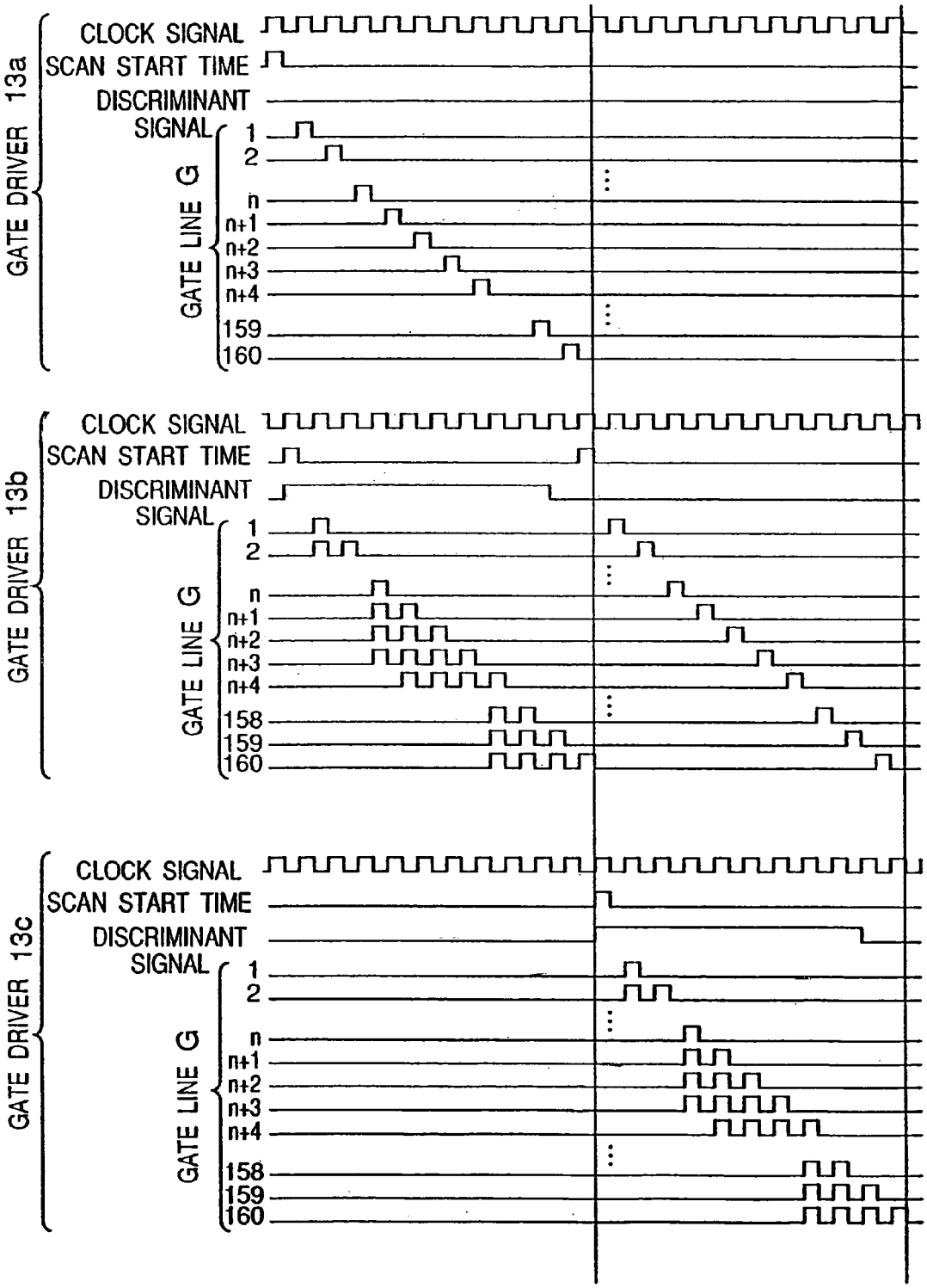
FIG. 5 is an explanatory view in the case where the analog switch of FIG. 4 is activated.

The LCD device having the above constitution operates in the following way to perform motion picture display. FIG. 5 is a timing chart of drive signals associated with three gate drivers 13*a*, 13*b*, 13*c* and select signals outputted to the gate lines G. As can be understood from FIG. 5, from the display control section 20, a clock signal half-cycle delayed from a clock signal supplied to the first gate driver 13*a* located at one end is supplied to the second gate driver 13*b* located at the center. Further, a clock signal half-cycle delayed from the clock signal supplied to the second gate driver 13*b* is supplied to the third gate driver 13*c* located at the other end. Also, the scan start signal supplied from the display control section 20 to the gate drivers 13*a*–13*c* is a pulse signal in which one pulse is present at the 1st clock and the 321st clock, and inputted to the individual gate drivers 13 with 160-clock phase delays. Further, the discriminant signal supplied from the display control section 20 to the gate drivers 13*a*–13*c* has, for example, "L" levels for 320 clocks and "H" levels for 160 clocks, and is inputted to the individual gate drivers 13 with 160-clock phase delays.

As a result, at first, the first gate line $G_1$ is selected by the first gate driver 13*a*. Then, the first to fourth gate lines G, i.e., totally the 161st to 164th gate lines $G_{161}$–$G_{164}$ are selected by the second gate driver 13*b*. Next, the second gate line $G_2$ is selected by the first gate driver 13*a*, and thereafter the 162nd–165th (2nd–5th) gate lines $G_{162}$–$G_{165}$ are selected by the second gate driver 13*b*. From this onward, likewise, selections are sequentially done by the two gate drivers 13*a*, 13*b* and then the 320th (160th) gate line $G_{320}$ is selected by the second gate driver 13*b*.

Subsequently, the first gate line G, i.e. totally 161st gate line $G_{161}$, is selected by the second gate driver 13*b*, and thereafter the first to fourth gate lines G, i.e. totally 321st–324th gate lines $G_{321}$–$G_{324}$ are selected by the third gate driver 13*c*. Next, the 162nd (2nd) gate line $G_{162}$ is selected by the second gate driver 13*b*, and thereafter the 322nd–325th (2nd–5th) gate lines $G_{322}$–$G_{325}$ are selected by the third gate driver 13*c*. From this onward, likewise, selections are sequentially done by the two gate drivers 13*b*, 13*c* and then the 480th (160th) gate line $G_{480}$ is selected by the third gate driver 13*c*.

Subsequently, the first gate line G, i.e. totally 321st gate line $G_{321}$, is selected by the third gate driver 13*c*, and thereafter the first to fourth gate lines $G_1$–$G_4$ are selected once again by the first gate driver 13*a*. Then, after the 480th (160th) gate line $G_{480}$ is selected by the third gate driver 13*c*, the 160th gate line $G_{160}$ is selected by the first gate driver 13*a*, where a one-frame scan is completed.

Figure 6:
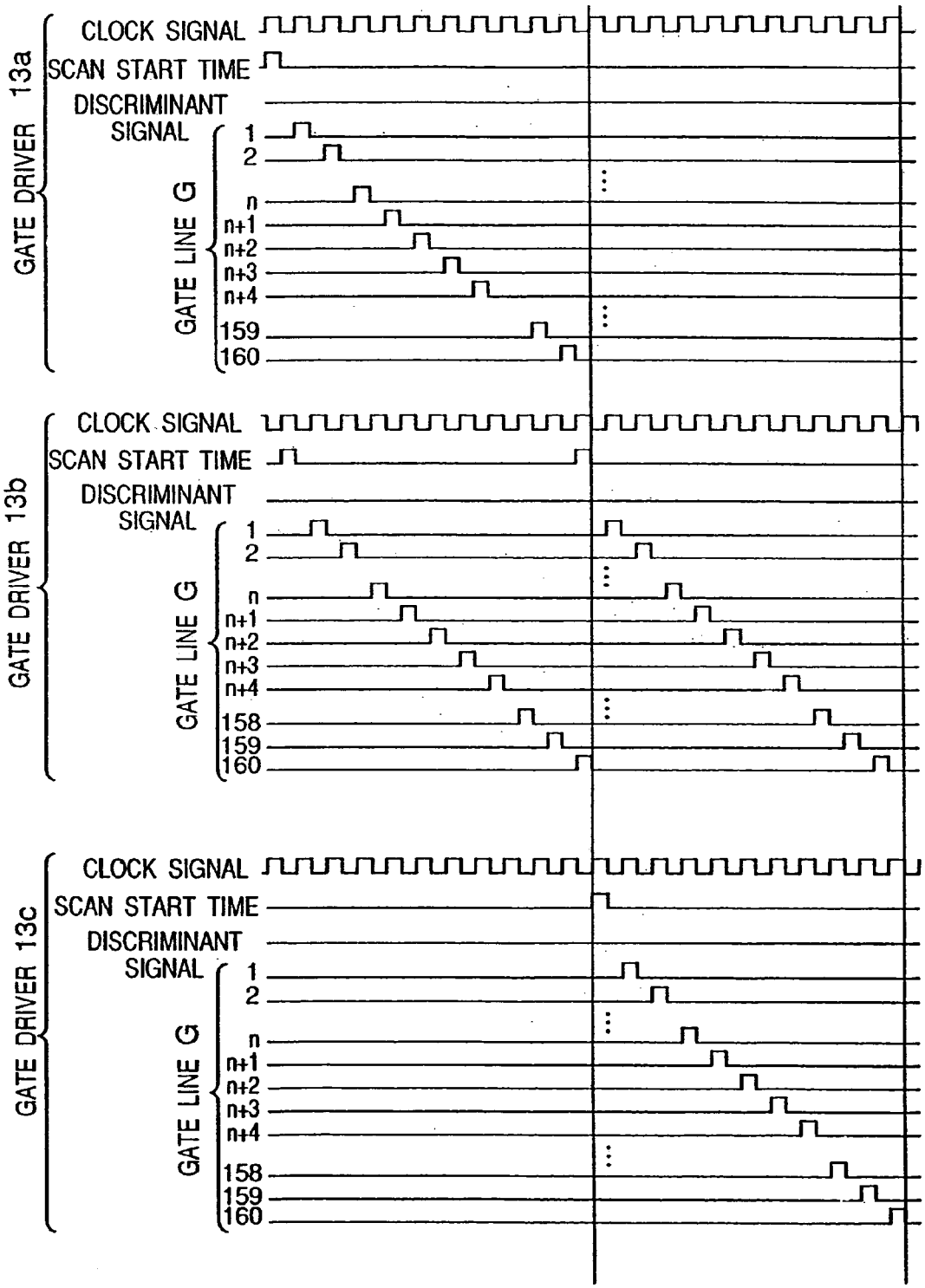
FIG. 6 is a timing chart of drive signals for the three gate drivers in the first embodiment and select signals outputted to the gate lines.

The timing chart shown in FIG. 5 assumes a case where the discriminant signal in which "H" levels for 160 clocks are present is sequentially given to the individual gate drivers 13*b*–13*a*, as described above. In this case, since the analog switch 43 is turned on in a gate driver 13 in which the discriminant signal is at "H" level, consecutive four gate lines G are selected by the gate driver 13. In contrast to this, when a discriminant signal in which all the levels are "L" is given to the individual gate drivers 13, the analog switches 43 of all the gate drivers 13 are off and therefore one gate line G at each time is selected by adjacent two gate drivers 13 alternately and with a shift as shown in FIG. 6.

Now image display operation by the LCD device of this embodiment is explained more concretely. In the way described above, the column of source drivers 12 outputs the data signal stored in the holding memory 32 and the reset signal alternately. In this case, the pulse width of the switching clock to be inputted to the selector switch 34 is so set that the two signals become equal in the width of output time. The width of the output time in this embodiment is about 16.7 ms (1 frame period)/480 lines/2≈about 17 μs.

It is also assumed that such a clock signal and a scan start signal as well as a discriminant signal in which all the levels are "L" as described above are inputted to the gate drivers 13 that select among the horizontal lines. Then, as shown in FIG. 6, after the nth gate line G is selected, the (n+160)th gate line G is selected. Further, after the (n+1)th gate line G is selected, the (n+161)th gate line G is selected. However, when (n+m) is larger than the number of lines, a select line is determined by counting the lines, in succession to the last line, from the head line. The width of the selection time for each gate line G is about 17 μs like the width of output time of the signal to the source lines S. In this case, timings of the switching clock and the scan start signal are preparatorily set so that a source driver 12 selects the nth gate line G for an output of the data signal, and that the source driver 12 selects the (n+160)th gate line G for an output of the reset signal.

The reason why the reset signal is given to the gate line G (m=160) that is 160-line forward of the gate line G to which the data signal has been outputted is as follows. The response time in which the transmissivity of liquid crystals changes from 100% to 10% is about 4 ms. When the reset signal is applied to the pixel electrode of one pixel connected to one gate line G, it is necessary that a generally black display be presented before the next data signal is applied. Therefore, the following relationship holds:

$$f \times m/N > 4\ ms$$

where f is the one frame period (16.7 ms), and

N is the total number of gate lines (480 lines).

Consequently, it is necessary that m>115.

In this embodiment, three gate drivers 13 each connected to 160 gate lines G are arranged in a straight line so as to scan 480 gate lines. Therefore, if m=160, then the requirement that m>115 can be satisfied only by a very simple control that a gate driver 13 succeeding the gate driver 13 that is currently outputting the data signal outputs the reset signal to a gate line G having the same number as the gate line G to which the data signal is outputted.

Figure 7:
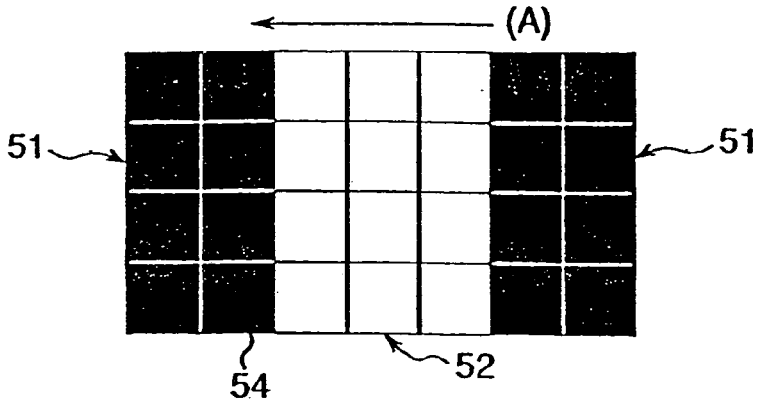
FIG. 7 is an explanatory view of an image used for the explanation of motion picture display operation.

A comparison between a display result by such an image display operation and a display result by a conventional LCD device is made below. The image used in this description is so formed that, as shown in FIG. 7, a white band 52 having a width corresponding to three pixels is arrayed longitudinally in the center of a black background 51. This white band 52 is assumed to be a motion picture that moves on pixel by pixel every one frame as indicated by arrow (A).

Figure 8:
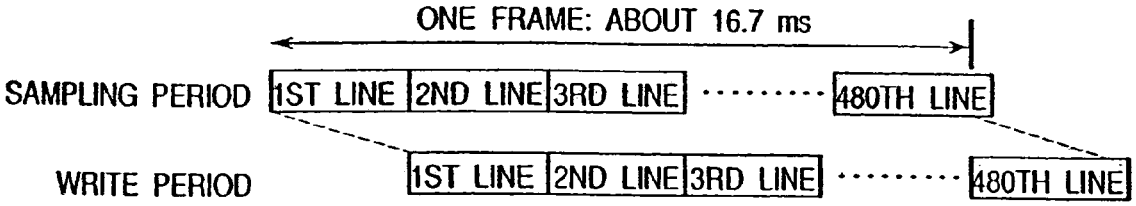
Fig.8 PRIOR ART
FIG. 8 is a view showing an image display sequence according to the prior art.
Figure 31:
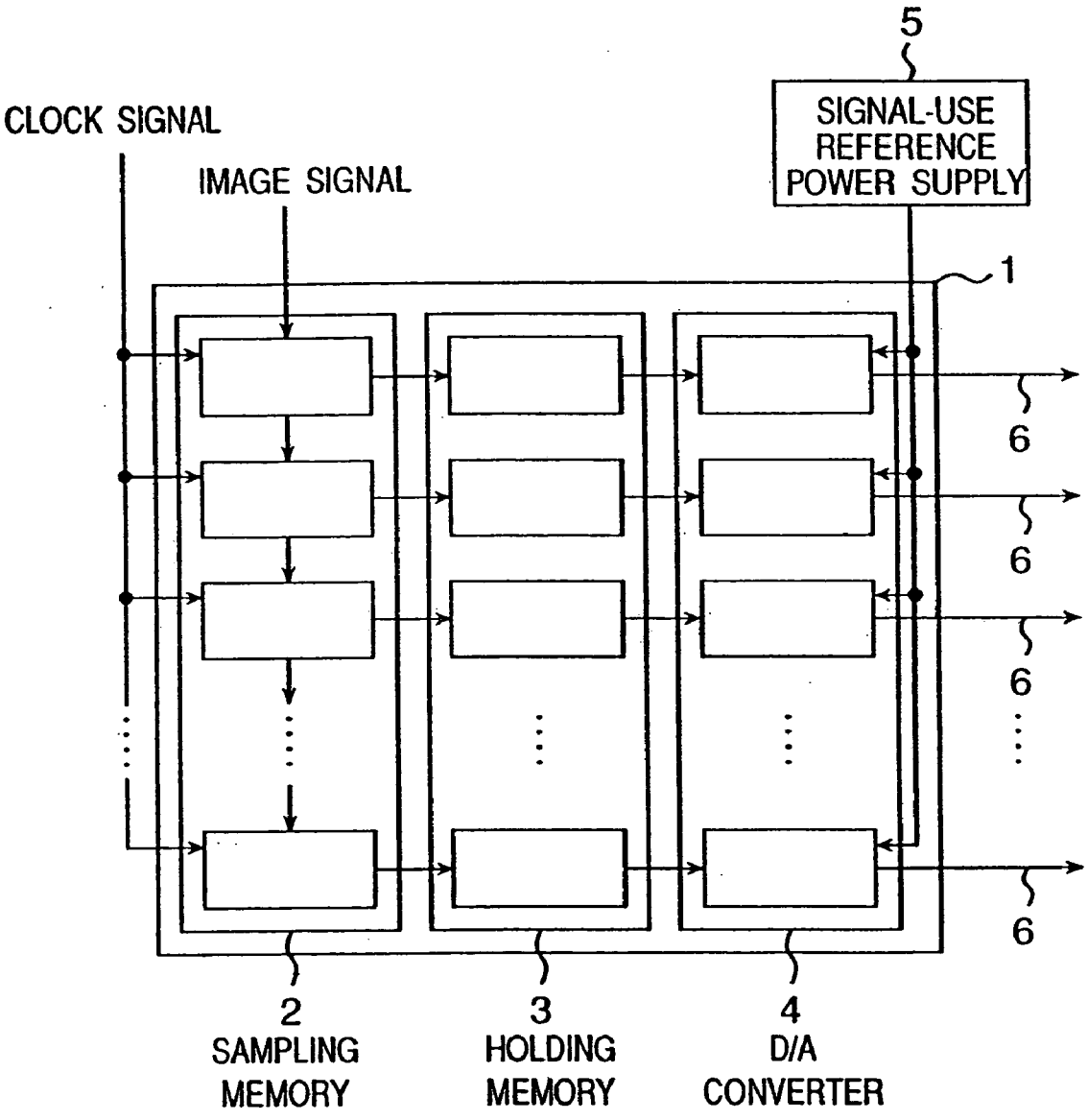
Fig.31 PRIOR ART
FIG. 31 is a schematic block diagram of the source driver in an LCD device according to the prior art.

First, the image display method by the conventional LCD device is described. An image display sequence of one frame period by the conventional LCD device is shown in FIG. 8. One-horizontal-line portions of an image signal delivered successively are sampled to the sampling memory 2 (see FIG. 31) of the source driver 1 and temporarily stored into the holding memory 3. Then, the one-horizontal-line data signal read from the holding memory 3 is written into a row of pixels constituting the one horizontal line selected by the gate driver. Concurrently therewith, a data signal of the second horizontal line is sampled to the sampling memory 2 and the contents of the holding memory 3 are rewritten. This is iterated for 480 horizontal lines, by which data signal writing for one frame is completed.

In this case, a liquid crystal of the normally white type TN (Twisted Nematic) mode is employed. As its characteristics, the time for transmissivity to change from 0% to 90% is about 20 ms and the time to change from 100% to 10% is about 4 ms.

Figure 9:
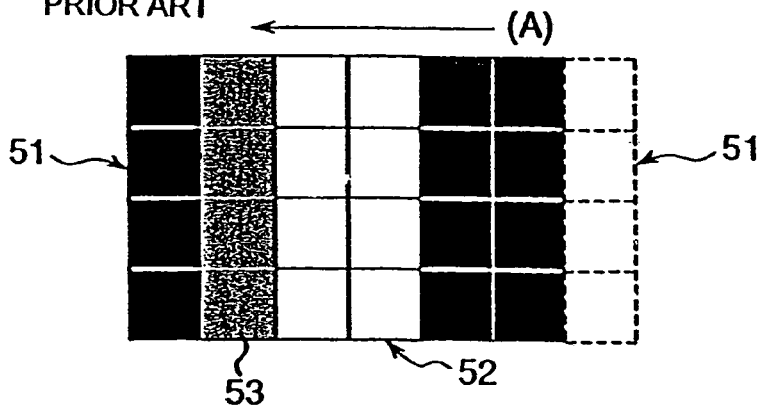
Fig.9 PRIOR ART
FIG. 9 is an explanatory view of a blur that arises in the image shown in FIG. 7.

When such a motion picture is displayed by the image display sequence of the conventional LCD device, an apparent afterimage (blur of image) can be seen in a pixel column 53 that has changed from the background 51 to the white band 52 as shown in FIG. 9. The cause of this can be explained as follows. FIG. 10 shows a frame-by-frame transmissivity variation in an arbitrary pixel 54 adjacent to the white band 52 forward of the white band 52 in its moving direction in FIG. 7. This transmissivity variation is expected, ideally, to show a black display (transmissivity<10%) in the first frame, a white display (transmissivity>90%) in the second to fourth frames, and again a black display in the fifth frame. However, the liquid crystals have characteristics that the time for the transmissivity to change from 0% to 90% is about 20 ms and that the time to change from 100% to 10% is about 4 ms, as described above. Therefore, when a white signal is written in the second frame into the pixel 54, which has indicated the black display in the first frame, liquid crystals of the pixel 54 are unable to complete a response within the frame period and complete generally in the third frame. Thus, the pixel 54 indicates the original white display in the fourth frame. Then, a black signal is written in the fifth frame.

FIG. 9 shows a motion picture displayed by the image display sequence of the conventional LCD device in the second frame when the white band 52 shown in FIG. 7 moved on by one pixel in the direction indicated by arrow (A). Because the time for transmissivity to change from 0% to 90% is about 20 ms, as discribed above, liquid crystals of the pixel column 53 can not indicate completely the white display and thus the afterimage (blur of image) is observed. Consequently, by the conventional image display sequence, the white band 52 could not be seen apparently three-pixel wide.

Next, image display operation by the LCD device of this embodiment is explained. In this LCD device, a reset signal of a voltage that allows the black display to be achieved within one frame period is written between data signal writes to individual horizontal lines. An image display sequence in the LCD device of this embodiment is shown in FIG. 11, where FIG. 11B details write and reset periods in FIG. 11A. As shown in FIG. 11, in this embodiment, data signal write and reset signal write are performed alternately at ½ cycles of the sampling cycle. In this case, the reset signal write is executed for a horizontal line that is 160-line forward of the horizontal line to which the data signal is written.

Figure 12:
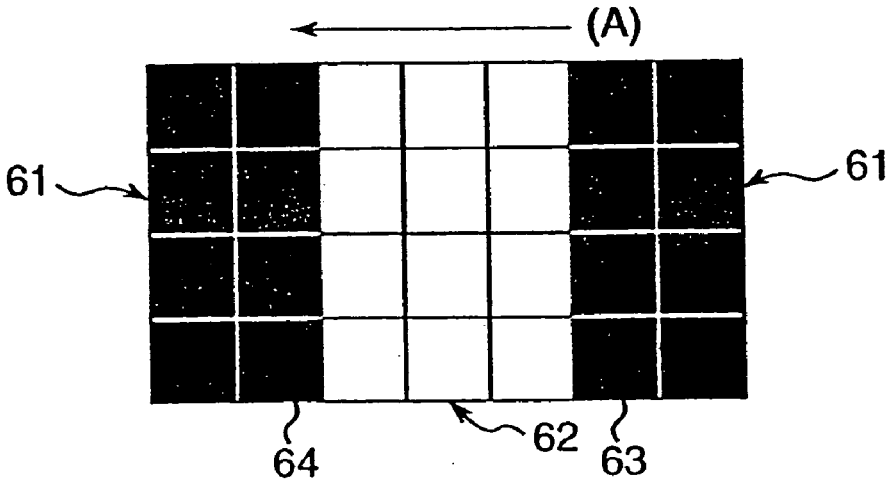
FIG. 12 is a view showing a display result of the image shown in FIG. 7 based on the image display sequence of FIG. 11.
Figure 13:
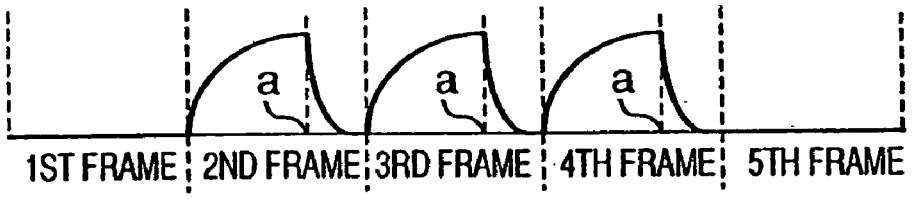
FIG. 13 is a view showing a frame-by-frame transmissivity variation based on the image display sequence of FIG. 11.

In this embodiment, by virtue of adopting such an image display sequence, no afterimage (blur of image) can be discerned in a pixel column 63 that has changed from a white band 62 to a background 61 as shown in FIG. 12. The reason of this can be explained as follows. FIG. 13 shows a frame-by-frame transmissivity variation in an arbitrary pixel 64 (corresponding to the pixel 54 in FIG. 7) adjacent to the white band 62 forward of the white band 62 in its moving direction in FIG. 12. This pixel 64 indicates the black display in the first frame. Then, a white signal is written in the second frame. However, at a time point "a" within the frame period (the time point that first occurs after the white signal is written to a horizontal line that is 160-line backward of the horizontal line to which the pixel 64 belongs), a black signal is written. The voltage of this black signal is a voltage that allows the black display to be achieved within one frame period as described before, and the time point "a" is set so that the transmissivity reaches 10% within the remaining time of the second frame. Therefore, a return to the black display can be achieved before the next frame comes up.

This is the case also in the third and fourth frames. Therefore, in the second to fourth frames, the white signal is written for the same time period into the pixel 64, so that the maximum transmissivity becomes identical among the frames. As a result, identical-brightness display can be achieved in the second to fourth frames. Further, in the fifth frame, because the black signal has already been written after the time point "a" of the fourth frame, the transmissivity exhibits 10% or lower at the start time point, so that no light leakage is observed.

Figure 14:
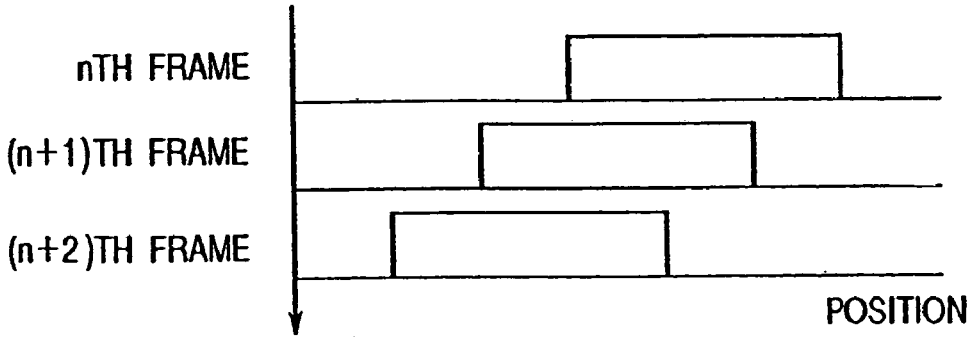
FIG. 14 is a view showing a movement of a white band in an arbitrary horizontal line in the image shown in FIG. 7.
Figure 15:
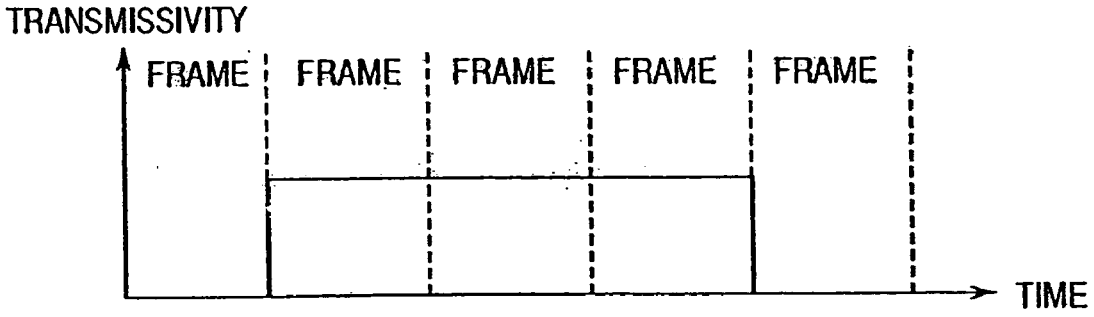
Fig.15 PRIOR ART
FIG. 15 is a view showing a response waveform of transmissivity in the image display sequence of the prior art, given an infinitesimal response time of liquid crystals.
Figure 16:
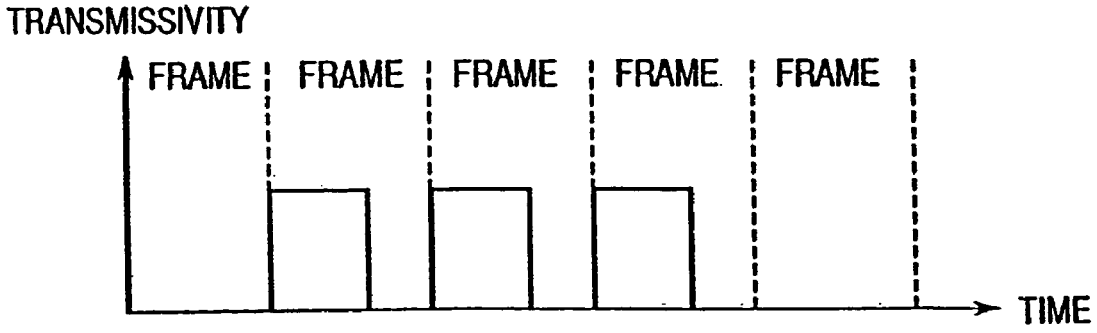
FIG. 16 is a view showing a response waveform of transmissivity in the image display sequence of FIG. 11, given an infinitesimal response time of liquid crystals.

Also, the reduction of afterimages by the image display sequence of this embodiment can be accounted for also by the following reason. For an easier explanation, a description is made on a case where the response time of liquid crystals is infinitesimal. The picture used in this explanation is a motion picture in which a three-pixel wide white band moves on pixel by pixel on the frame basis as described above, and a movement of the white band at an arbitrary horizontal line is shown in FIG. 14. Besides, with respect to the response waveform of transmissivity in the infinitesimal response time, a case of the image display sequence of the prior art is shown in FIG. 15, and a case of the image display sequence of this embodiment is shown in FIG. 16.

Figure 17:
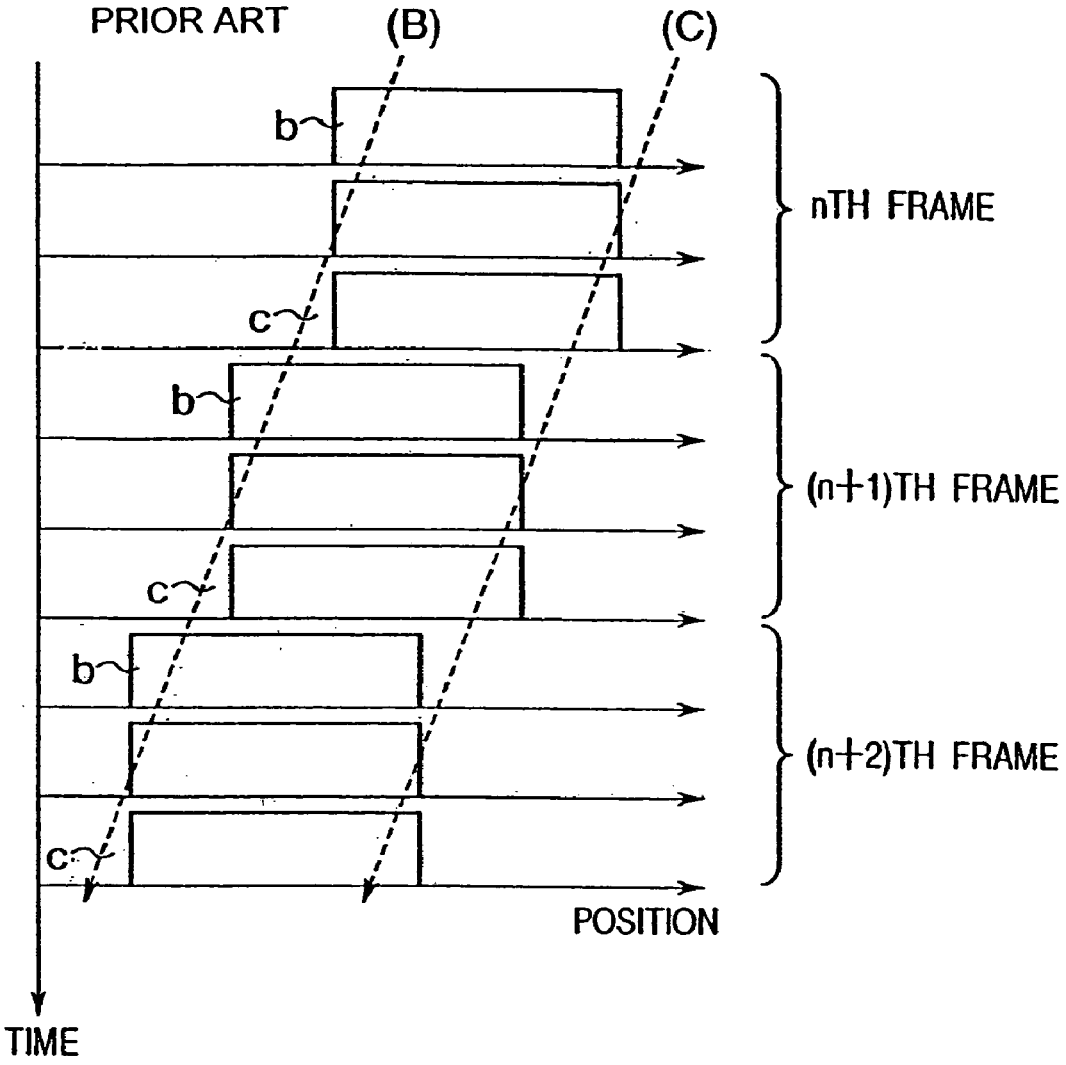
FIG. 17 is a view showing a movement of the white band as well as a movement of a human point of view in the image display sequence of the prior art.

FIG. 17 shows a movement of the white band in an arbitrary horizontal line according to the image display sequence of the prior art. A data signal written into an arbitrary pixel is held during the frame period, so that the white band keeps halted during one frame period. Then, upon entrance into the succeeding frame period, the white band moves by one pixel and keeps halted again during one frame period. From this onward, these steps are iterated. Then, when this motion of the white band is observed by a person, the person discerns a motion picture that the white band smoothly moves. In other words, it cannot be discerned that the white band takes a halt frame by frame. On account of this, the human point of view moves at a constant speed as shown by broken-line arrows (B) and (C) in FIG. 17.

Figure 18:
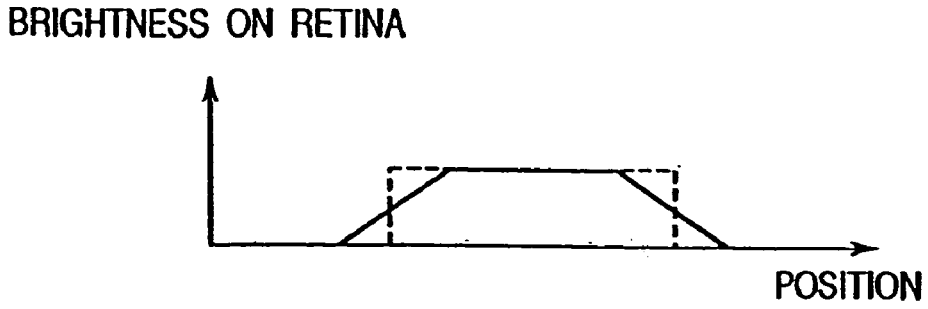
FIG. 18 is a view showing a state of brightness declines at both edges of the white band due to a shift between the movement of the white band and the movement of the human point of view shown in FIG. 17.

Accordingly, the human retina feels a brightness with motion added thereto as shown in FIG. 18. As a result, the person feels a blurred afterimage in which both edges are duller than the actual white band image based on the data signal. In other words, since the human eyes feel that the white band smoothly moves regardless of its halting frame by frame, the result is that the white band is present forward of the human eyes as indicated by "b" in the first half of one frame, and that the white band is present backward of the human eyes as indicated by "c" in the second half of one frame because of the human eyes' leaving the white band behind. Thus, an image in which the "presence or absence" of the white-band image has been averaged is projected onto the human retina, a white-band image dulled at edges and blurred is discerned. As explained above, blurs of a motion picture are unavoidably felt in the image display sequence of the prior art.

Figure 19:
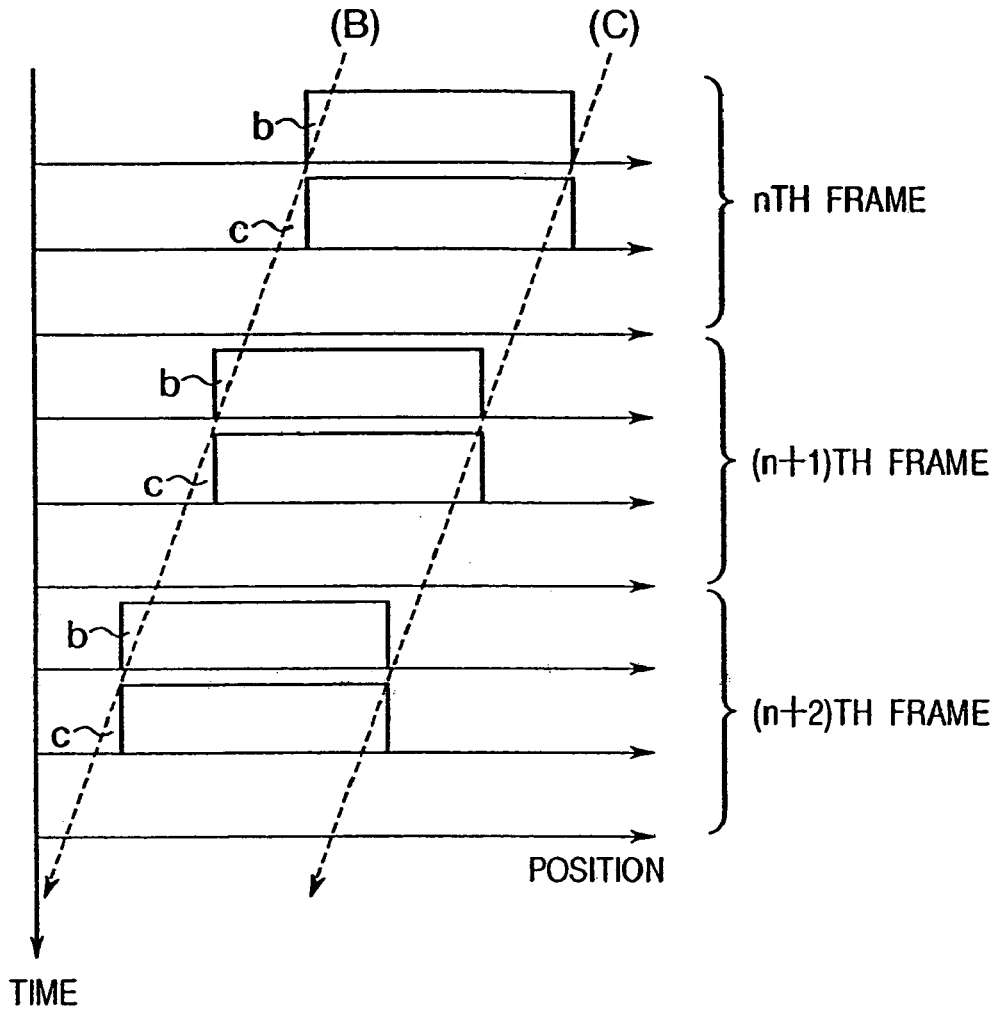
FIG. 19 is a view showing a movement of the white band as well as a movement of a human point of view in the image display sequence shown in FIG. 11.
Figure 20:
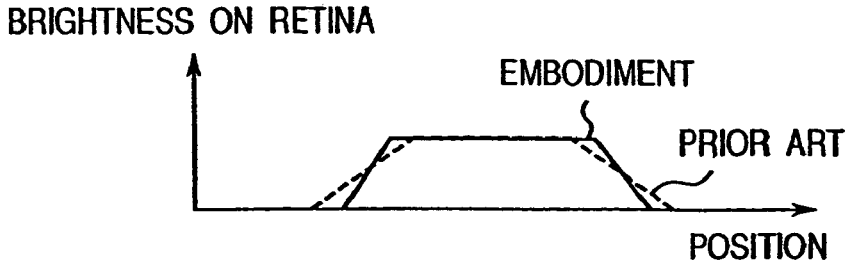
FIG. 20 is a view showing a state of brightness declines at both edges of the white band due to a shift between the movement of the white band and the movement of the human point of view shown in FIG. 19.

Next, the image display sequence by the LCD device of this embodiment is described. FIG. 19 shows a movement of the white band in a horizontal line by the image display sequence of this embodiment. In this image display sequence, since "m", which is the difference between the reset-signal write line number and the data-signal write line number, is set to "160," the data signal is held for a first ⅔ of one frame period, and the black signal is held for the remaining ⅓ to indicate a black display. That is, the white band keeps halted for the first ⅔ of one frame period, and disappears for the remaining ⅓. Accordingly, the white-band display period can be reduced to ⅔ of one frame period, so that, as apparent from comparison between FIG. 19 and FIG. 17, both the period in which the white band indicated by "b" is present forward of the human eyes and the period in which the white band indicated by "c" is present backward of the human eyes can be shortened. For this reason, resultantly, the blurs at edges of the white-band image can be reduced as shown in FIG. 20.

In the above description, it is assumed that the response time of liquid crystals is infinitesimal for simplicity. However, even if the response time of liquid crystals is not infinitesimal, similar effects can be obtained when the black display is executed frame by frame, apparently from the above description.

In this connection, as can be seen from the comparison between FIG. 15 and FIG. 16, this embodiment includes, on the frame basis, a step in which a black transmissivity changes to an arbitrary transmissivity, and a step in which an arbitrary transmissivity changes to a black transmissivity, so that the transmissivity is substantially lower than in the case where the conventional image display sequence is applied. Therefore, in order to obtain a brightness equivalent to that in the application of the conventional image display sequence, there is a need of increasing the brightness of backlight.

Thus, in view of adopting this LCD device in portable equipment, there is provided a motion picture/still picture discriminating circuit 21 for automatically discriminating whether a current displayed picture is a picture composed mainly of dynamic image or a picture composed mainly of static image, by monitoring several points on the screen. Then, if the picture is discriminated to be a motion picture based on a discrimination result by the motion picture/still picture discriminating circuit 21, the brightness of the backlight is increased by the backlight adjusting circuit 23. Also, if the picture is discriminated to be a still picture, the brightness of the backlight is lowered. By so doing, the power consumption can be reduced, compared with the case where the brightness of the backlight is normally fixed to one matching motion pictures, so that an LCD device for portable use superior in motion picture display grade can be obtained with a minimum essential increase in power consumption.

Instead of providing the motion picture/still picture discriminating circuit 21, a switch for selecting between the image display sequence of this embodiment and the conventional image display sequence may be provided so as to allow the user to select either of the image display sequences. Then, when the switch is changed over to the image display sequence of this embodiment, the brightness of the backlight is synchronously increased by the backlight adjusting circuit 23. In this case also, an LCD device superior in motion picture display grade can be obtained with a minimum essential increase in power consumption.

Figure 21:
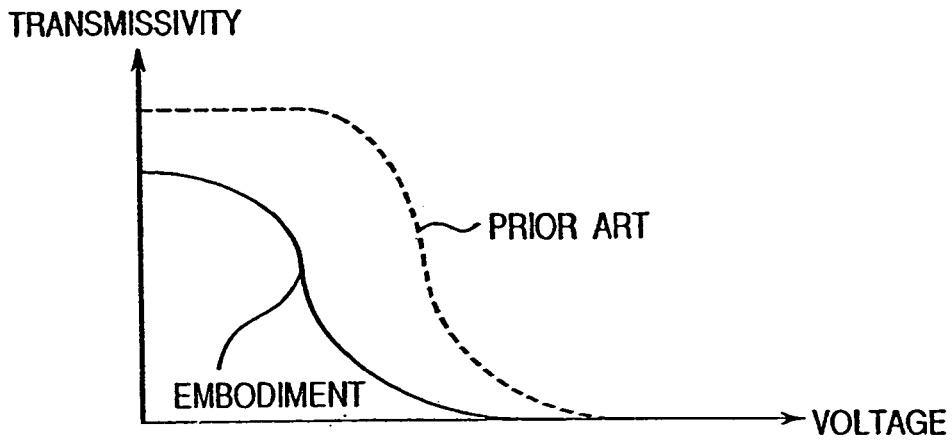
FIG. 21 is a view showing relationships between write voltage and transmissivity in the image display sequence shown in FIG. 11 and the image display sequence of the prior art.
Figure 22A:
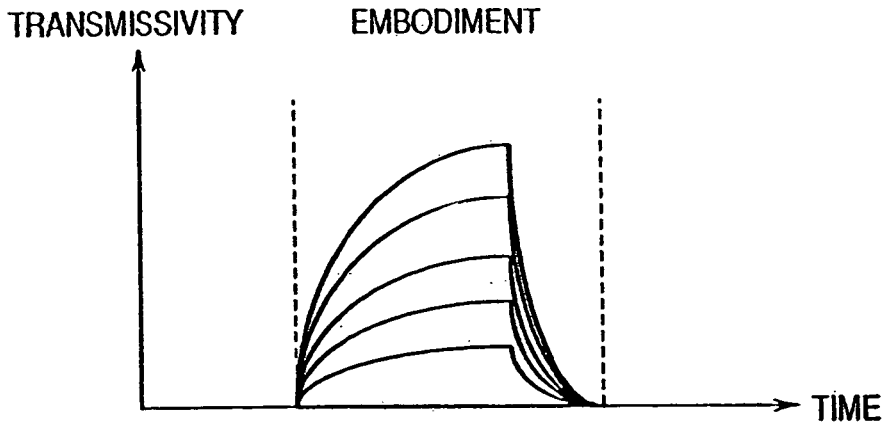
FIG. 22A is a view showing time variations of transmissivity at various gray levels in the image display sequence shown in FIG. 11.
Figure 22B:
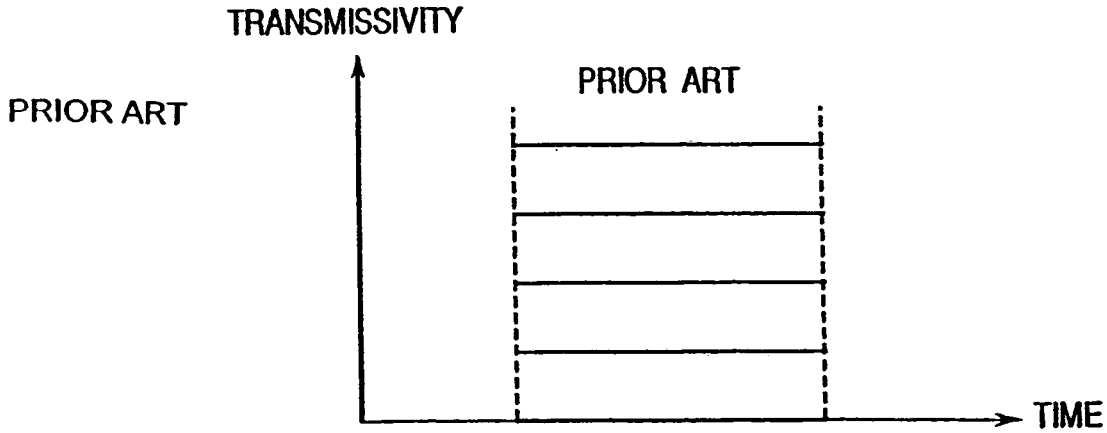
FIG. 22B is a view showing time variations of transmissivity at various gray levels in the image display sequence of the prior art.

Further, because this embodiment includes, on the frame basis, both a step in which a black transmissivity changes to an arbitrary transmissivity and a step in which an arbitrary transmissivity changes to a black transmissivity as described above, the relationship between write voltage and transmissivity differs from that of the conventional image display sequence as shown in FIG. 21. Besides, as shown in FIG. 22, time variations of transmissivity at various gray levels differ between the image display sequence of this embodiment and the conventional image display sequence.

Therefore, with considerations given to these results, when the image display sequence of this embodiment is adopted, write voltages at various gray levels are largely re-adjusted in amplitude by referencing the black display by means of the signal-use reference power supply 22 based on the discrimination result of the motion picture/still picture discriminating circuit 21, thus allowing a successful gray-level balance to be obtained, compared with the case where the conventional image display sequence is adopted.

As shown above, in this embodiment, a VGA panel is used as the liquid crystal panel 11. Further, each source driver 12 is equipped with a selector switch for selectively outputting both the data signal stored in the holding memory 32 and the reset signal based on a black signal voltage to source lines S during one horizontal line sampling period. Also, the 480 gate lines G are divided into three groups each comprising 160 lines, and the gate lines G of the individual groups are connected to the first gate driver 13*a*–third gate driver 13*c*.

Then, clock signals which are delayed in phase from one another by the half cycle are supplied from the display control section 20 to the first gate driver 13*a* –third gate driver 13*c*. Further, from the display control section 20, a scan start signal in which one pulse is present at the 1st clock and the 321st clock is inputted with 160-clock phase shifts.

Therefore, the timings for the switching clock and the scan start signal are so set that the gate driver 13 selects the nth gate line G when the source driver 12 outputs the data signal, and that the gate driver 13 selects the (n+160)th gate line G when the source driver 12 outputs the reset signal. With this setting, into pixels in which the data signal has been written, the reset signal is written during the remaining ⅓ of the frame, as shown in FIG. 13.

In this connection, if the voltage of the reset signal (i.e., voltage of the black signal power supply 24) is set to a voltage that allows the black display to be achieved within one frame period, then a return to the black display can be achieved before the succeeding frame comes up. That is, according to this embodiment, when a black signal is written in the succeeding frame into a pixel in which a white signal has been written, the black signal has already been written during the latter ⅓ of the preceding frame and therefore the transmissivity exhibits 10% or lower at the start time point of the current frame, so that light leakage cannot be observed.

Further, image edge portions of a motion picture iterate moves and halts in each frame. In this connection, since humans cannot discern a halt of the edge portions, the edge portions look smoothly moving. Besides, in this embodiment, the reset (black) signal is written during the latter ⅓ of the frame into the pixel in which the data signal has been written, so that the image disappears. However, since humans cannot discern that the image has disappeared, both the period in which the image edge portions are present forward of the human eyes, and the period in which the edge portions are present backward are shortened. Thus, resultantly, blurs at the edge portions of the motion picture can be reduced as shown in FIG. 20.

Also, in this embodiment, there is provided a motion picture/still picture discriminating circuit 21 for automatically discriminating whether the displayed picture is a picture composed mainly of dynamic image or a picture composed mainly of static image. Then, if the picture is discriminated to be a motion picture by the motion picture/still picture discriminating circuit 21, the brightness of the backlight is increased by the backlight adjusting circuit 23. Accordingly, during the display of a motion picture, reduction of transmissivity caused by the write of the reset signal during the latter ⅓ of one frame can be prevented with a minimum essential increase in power consumption.

Consequently, according to this embodiment, by applying a minimum essential improvement to an LCD device equipped with the conventional VGA panel, the motion picture display grade can be improved with a minimum essential increase in power consumption.

Although the above description of operation has been made by taking an example of motion picture display, yet still pictures can also be displayed, needless to say. For the display of a still picture, a switching clock signal for still pictures in which all the levels are "H" is outputted from the display control section 20 to the source driver 12, and the data signal alone is outputted over the whole sampling period for one horizontal line. Further, while the scan start signal for still pictures in which one pulse is present is inputted to the gate drivers 13*a*–13*c* with 160-clock phase shifts, a discriminant signal for still pictures which is at "L" level is outputted to the gate drivers 13. Thus, as in the conventional LCD device, the data signal is outputted to all the source lines S while 480 gate lines G are selected sequentially from one end, by which a picture is displayed.

Although the relationship in voltage between the signal-use reference power supply 22 and the black signal power supply 24 is not particularly described in the above description, setting the following relationship makes it possible to further improve the display grade. Assuming that the reference voltage (black reference voltage) for black images from the signal-use reference power supply 22 is Vd and that the voltage of the black signal power supply 24 is Vr, and in the case of positive polarity with respect to the potential level of the counter electrodes 18, then the two voltages are set so that Vd<Vr for the normally white mode, and that Vd>Vr for the normally black mode. In contrast, in the case of negative polarity, the two voltages are set so that Vd>Vr for the normally white mode, and that Vd<Vr for the normally black mode. By so doing, deficiency of the supply time for the black display signal can be compensated so that a further improvement in the display grade can be achieved.

Normally, the TFTs (switching devices) 17 require a supply time of 20.5 μs at the shortest to securely supply a signal voltage. Meanwhile, as described above, when the VGA panel is driven with one frame period of 16.7 ms (= 16700 μs), that is, when 480 gate lines G are driven at 60 Hz, one horizontal period is $$10^6\ \mu s/60\ (Hz)/480\ (\text{lines})=34.7\ \mu s.$$

Therefore, data signal supply time and black signal supply time are set as:

data signal supply time=20.8 μs, and black signal supply time=34.7 μs−20.8 μs=13.9 μs.

Figure 23:
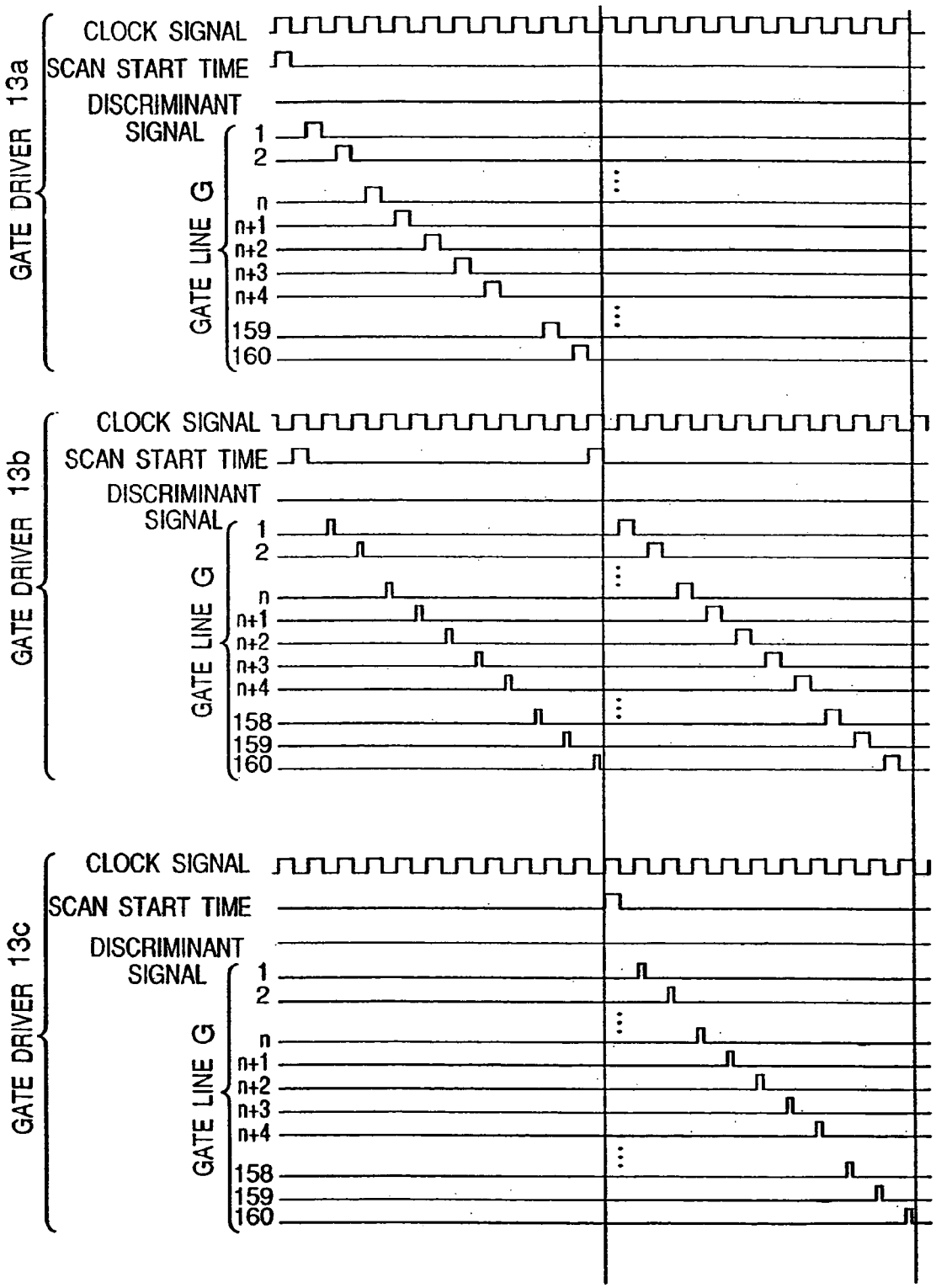
FIG. 23 is a timing chart of drive signals and select signals other than that of FIG. 6.
Figure 24:
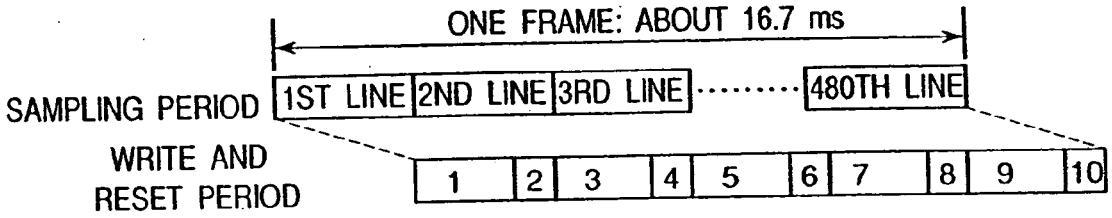
FIG. 24 is a view showing an image display sequence other than that of FIG. 11.

In addition, FIG. 23 shows a timing chart of drive signals and select signals, and FIG. 24 shows an image display sequence.

By setting the individual signal supply times in this way, it is enabled to securely supply the data derived from the source drivers 12 to the pixel electrodes 16. In addition, it is considered that with shorter black signal supply time, enough supply of a black signal (charging of pixel capacitance) would no longer be fulfilled. However, in most LCD elements, it can be seen from the voltage-transmissivity curve that in the vicinity of black display, a dull transmissivity variation relative to voltage (where the transmissivity is saturated to 0 in the vicinity of black display) is shown so that enough effect can be obtained even with more or less deficiency of black signal supply. In this embodiment, one frame period is defined as a time period required to display a picture for the entire screen of the LCD device regardless of the image signal system. For example, in the case of the interlace image signal system, generally, one frame period is composed of two fields, and the entire screen of the LCD device is displayed by one field period corresponding to ½ of the frame period. In this case, this one field period is regarded as one frame period in this embodiment. This is the case also with the other image signal systems. Further, it is assumed that this is also applicable to the following embodiments.

Second Embodiment

The LCD device in this embodiment is similar in general configuration to the active matrix type LCD device of the first embodiment shown in FIG. 1. However, the LCD device in this embodiment employs the S-XGA (super XGA) panel for the liquid crystal display section. The pixels count 1280 (tripled for color display)×1024, differing from the VGA panel of the first embodiment by about a double in terms of the number of gate lines G. Therefore, as in the first embodiment, if the data signal and the reset signal are alternately outputted with the same output time width, the selection time for one horizontal line is about 16.7 ms (one frame period)/1024 (lines)/2≈about 8.1 μs. Thus, enough signal write to the pixels (i.e., charging) cannot be achieved.

In addition, from the viewpoint of the power of the TFT devices that switch the connection between the particular electrodes and the source lines S, the selection time for one horizontal line is necessarily 12.0 μs at the least. Therefore, in this embodiment, the switching clock to be supplied to the selector switch 34 in the source drivers 12 is so set that 12.0 μs is assigned to the data signal write time, while the remaining 4.3 μs is assigned to the reset signal write time, out of the maximum selection time for one horizontal line, which is 16.7 ms (one frame period)/1024 (lines)≈16.3 μs.

Figure 25:
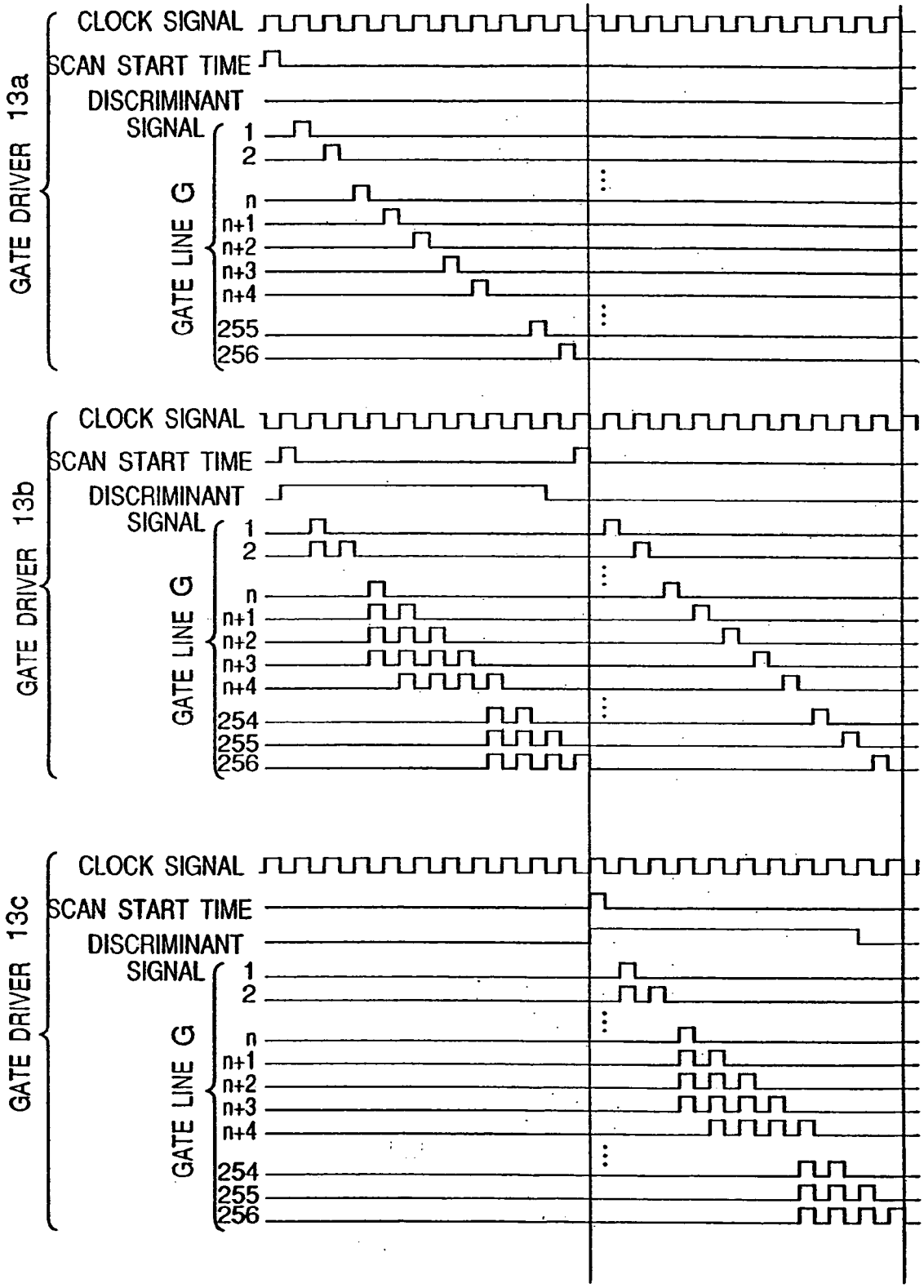
FIG. 25 is a timing chart of drive signals and select signals in a second embodiment.
Figure 26:
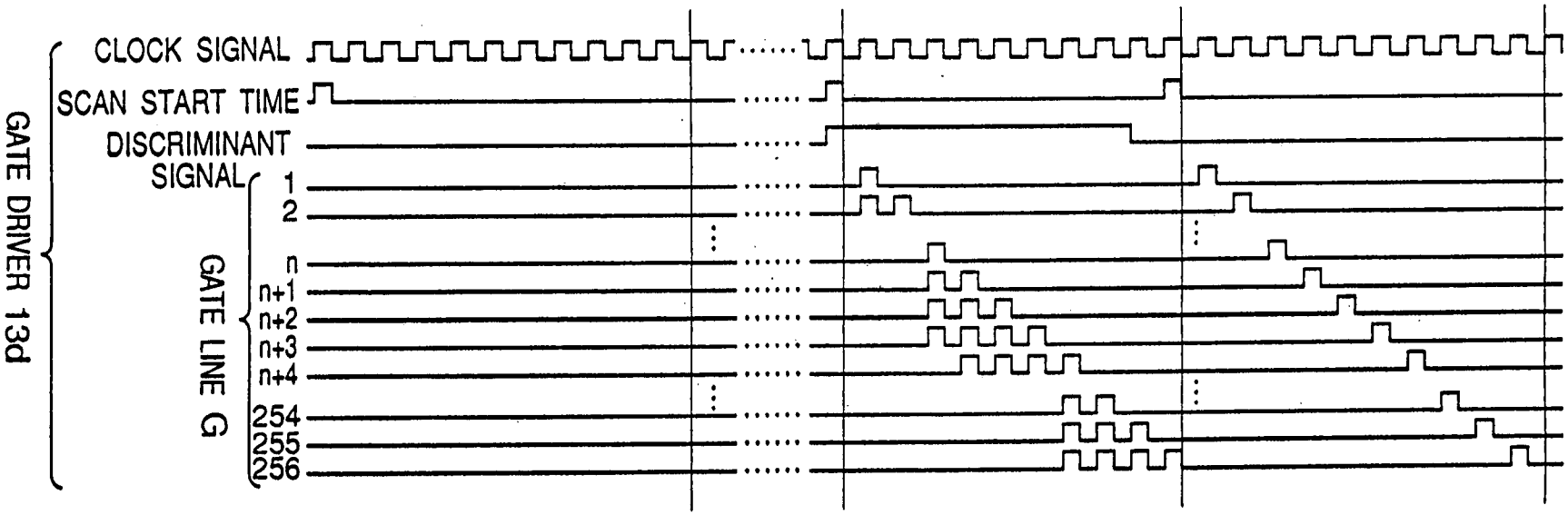
FIG. 26 is a timing chart continued from FIG. 25.

However, with such a reset signal write time, it is impossible to sufficiently write the reset signal by one selection period. Thus, in this embodiment, as shown in FIGS. 25 and 26, 1024 gate lines G are divided into four groups each comprising 256 lines, and connected to different four gate drivers (hereinafter, referred to as first gate driver 13*a*–fourth gate driver 13*d*) in group units. In addition, the basic configuration of each gate driver 13 is the same as that shown in FIG. 4. Then, for image display, a discriminant signal in which 768-clock "L" levels and 256-clock "H"

levels are present is inputted from the display control section 20 to the individual gate drivers 13 with a 256-clock phase shift. Also, a scan start signal in which one pulse is present at the 1st clock and the 769th clock is inputted to the individual gate drivers 13 with a 256-clock phase shift.

As a result, the analog switches 43 of gate drivers 13 whose discriminant signal level is "H" are turned on so that consecutive four gate lines G are selected at the gate driver 13. Then, by the adjacent two gate drivers 13, one gate line G and four gate lines G are alternately selected with shifts.

The image display sequence in the LCD device of this embodiment is as shown in FIG. 27. Detailed contents of write period and reset period in FIG. 27A are shown in FIG. 27B. As shown in FIG. 27, in this embodiment, the data signal write and the reset signal write are alternately executed with different time widths as shown above. In this case, based on the discriminant signal and the scan start signal derived from the display control section 20 as shown above, the reset signal write is executed simultaneously onto four continuous horizontal lines starting from the 256 forward horizontal line for data signal write.

By so doing, the reset signal can be written into the horizontal lines continuously four times during one frame, and as shown in FIG. 28, enough black display can be achieved even with a reset signal write time of 4.3 $\mu$s. That is, according to this embodiment, in an active matrix type LCD device employing an S-XGA panel as the liquid crystal panel 11, blurs and afterimages of motion picture display can be reduced.

In addition, the reason of giving the reset signal to a gate lines G that is 256 line forward of the gate line G to which the data signal has been outputted is as follows. The response time over which the liquid crystal transmissivity changes from 100% to 10% is about 4 ms as described above. When the reset signal is applied to the pixel electrode of one pixel connected to one gate line G, it is necessary that black display be indicated before the next data signal is applied. Therefore, the following relationship holds:

$$f \times m/N > 4\ ms$$

where f is the one frame period (16.7 ms), and

N is the total number of gate lines.

Therefore, it is necessary that m>246.

In this embodiment, four gate drivers 13 each connected to 256 gate lines G are arranged in a straight line so as to scan 1024 gate lines. Therefore, if m=256, then the requirement that m>246 can be satisfied only by a very simple control that a gate driver 13 succeeding the gate driver 13 that is currently outputting the data signal outputs the reset signal to a gate line G having the same number as the gate line G to which the data signal is outputted.

Also, in this embodiment, with such an arrangement that it is automatically decided by the motion picture/still picture discriminating circuit 21 whether the displayed picture is one composed mainly of dynamic image or another composed mainly of static image, and that if the picture is discriminated to be a motion picture, the brightness of the backlight is increased by the backlight adjusting circuit 23, an LCD device superior in motion picture display grade can be obtained with a minimum essential increase in power consumption.

The above description has been made on a case where after the data signal is written into the nth gate line G, the reset signal is written into continuous k gate lines G starting from the (n+m)th line. However, the k gate lines G, to which the reset signal is written, may also be divided into every-m-line p groups. In this case, the reset signal is written simultaneously into continuous k (=K/p) lines for each group.

Figure 29:
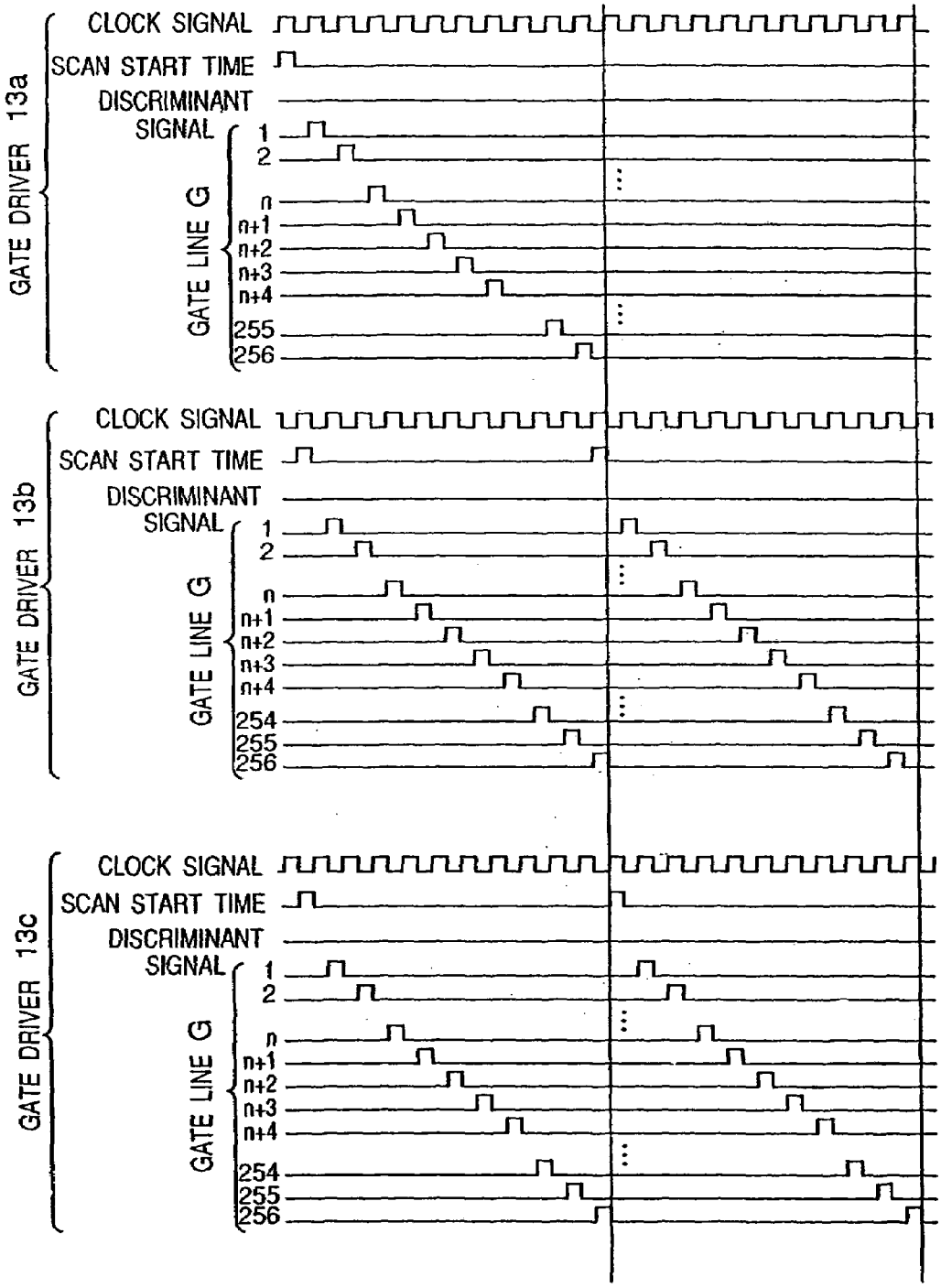
FIG. 29 is a timing chart other than FIG. 25.
Figures 30A, 30B:
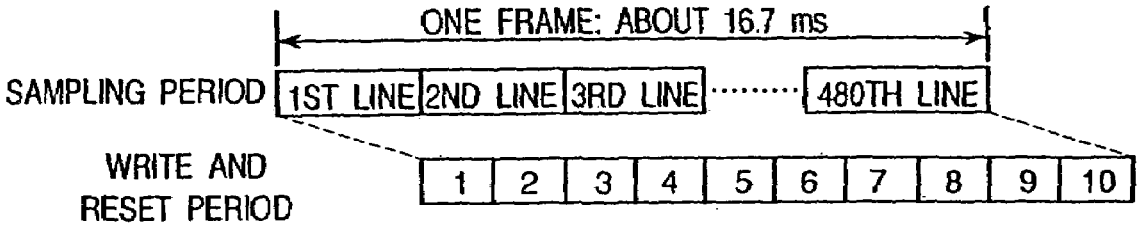
FIG. 30A is a view showing the image display sequence of FIG. 29.
FIG. 30B is a view showing details of write and reset periods in FIG. 30A.

FIG. 29 shows an example of the timing chart of drive signals and select signals (where the gate driver 13*d* is omitted). FIG. 30 shows an image display sequence of one frame period. It is noted that FIG. 29 is an example where m=256, p=2 and k=1.

As shown above, by writing the reset signals to the gate lines G in a dispersion into every-m-line p groups, the following effects can be produced. That is, liquid crystals have a characteristic that the liquid crystals start to respond to black display at a write start of the reset signal with the dielectric constant is gradually varied (due to dielectric anisotropy of liquid crystals). Therefore, even with a specified reset voltage applied to liquid crystals, the voltage actually applied to the liquid crystals would vary due to the variation of the dielectric constant.

However, by supplying the reset signal to k gate lines G in a dispersion into every-m-line p groups, the reset signal is supplied once each time m lines are scanned, with regard to one horizontal line. That is, liquid crystals respond to some extent to the first-time reset signal, so that the dielectric constant varies. Then, after the scanning of m lines, the second supply of the reset signal is executed to the liquid crystals that have changed in the dielectric constant. Therefore, by iterating this operation p times, black display can be obtained more reliably.

In other words, the signal supply to liquid crystals is an operation of applying signal voltage to the individual pixel capacitances (i.e., charging operation). Therefore, the dielectric constant of liquid crystals varies depending on the contents of display (state of orientation), and so the amount of charges varies depending on the contents of the preceding display. Consequently, even with the same signal supplied to the same pixel, a different display would result if the contents of the preceding display are different.

However, by writing the reset signal p times iteratively at time intervals that allow m gate lines G to be scanned as described above, an improvement on the issue of dielectric constant variation can be achieved so that a further successful black display can be obtained.

Third Embodiment

The LCD device of the first embodiment, when used under low temperatures, become lower in the response speed of liquid crystals, so that the data signal for the succeeding frame is written before the black display by the reset signal is completed. As a result, there is a problem that the amount of blurs of motion pictures is increased. Whereas this problem can be solved by applying the second embodiment, i.e., by switching the discriminant signal from the display control section 20, the problem can also be solved by controlling the response time which elapses while the transmissivity changes from one corresponding to the data signal to another corresponding to black, so that the response time falls within the frame period. Below described is a method for controlling the response time that elapses while the transmissivity changes from an arbitrary one corresponding to the data signal to another corresponding to black.

The following response time control methods are available:

(1) The difference, "m," between the reset-signal write line number and the data-signal write line number is increased with decreasing environmental temperature. By doing this, the reset-signal write time is elongated so that the response time at the write of the reset signal can be contained sufficiently within the frame period, and that the lowering of the response speed of liquid crystals can be compensated.

(2) The black signal voltage (i.e., reset signal voltage) derived from the black signal power supply 24 is increased together with decreasing environmental temperature. By doing this, the reset-signal write speed is increased so that the response time at the write of the reset signal can be contained sufficiently within the frame period, and that the lowering of the response speed of liquid crystals can be compensated.

The method of changing "m" in the method (1) may be embodied in various ways, an example is as follows. Shift registers 41 of gate drivers 13, which are divided into a plurality, are connected in series. Then, out of latch circuits constituting all the shift registers 41, an analog switch is connected to each of input terminals of the mth–(m+J)th latch circuits, and the input terminals of the mth–(m+J) th latch circuits are made ready for input of the scan start signal thereto via any of the (J+1) analog switches. Further, a control circuit for the analog switches is provided, and the (m+j(j≦J))th analog switch is turned on by this control circuit according to decrease of the environmental temperature.

In this embodiment, by embodying either one of the control methods (1) and (2), increases in the blur amount of the motion picture due to decrease in the response speed of liquid crystals can be avoided.

Also, whereas the second embodiment has been described on a case where the reset signal write is executed simultaneously for four horizontal lines, the present invention is not limited to four horizontal lines. Further, the write of the reset signal is no limited to any fixed number of horizontal lines, and the number of reset-signal write lines may be changeable without any problems. Although implementable in various ways, the method for changing the reset-signal write lines is, for example, as follows:

An analog switch is connected to each of input terminals of the second—Kth latch circuits in the gate drivers 13, and input terminals of the second—Kth latch circuits are made ready for the supply of the scan start signal derived from the analog switch 43 via any of the (K–1) analog switches. Further, a control circuit for the analog switches is provided, and the second—k(k≦K))th analog switches are turned on by this control circuit according to a "k" signal derived from external. In addition, the "k" signal is a signal for specifying the number of reset signal write lines.

In the above embodiments, the present invention has been described by taking an example in which the invention has been applied to an active matrix type LCD devices. However, needless to say, the invention is also applicable to duty type LCD devices.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device having:

a display panel in which are formed at least a plurality of column lines arranged in parallel to one another, a plurality of row lines arranged in parallel to one another in a direction in which the row lines intersect the column lines, and pixels provided corresponding to intersecting points of the column lines and the row lines;

a column line driver for supplying a data signal to the column lines; and a row line driver for supplying a select signal to the row lines, wherein the liquid crystal display device comprises:

a display control section for supplying an image signal and a control signal to the column line driver, while supplying a control signal to the row driver, thereby controlling image display operation to the display panel;

black display signal generating means for generating a black display signal for displaying a black image at the pixels; and a selector switch provided in the column line driver for switchedly selecting alternately between a data signal based on an image signal derived from the display control section and a black display signal derived from the black display signal generating means, wherein the display control section selectively outputs a control signal for a first display mode or a control signal for a second display mode, such that in the first display mode, the control signal for making the row lines sequentially selected is supplied to the row line driver, where the select signal is supplied to the nth (n: a positive integer) row line while the data signal is selected by the selector switch, and where the select signal is supplied to at least one of the row lines other than the nth row line while the black display signal is selected by the selector switch, and such that in the second display mode, only the data signal is selected by the selector switch and a black display signal supply operation is not performed.

2. The liquid crystal display device according to claim 1, wherein the row lines are divided into L (where L is a positive integer) blocks on an m-line (m: a positive integer) basis; and the row line driver comprises L partial row line drivers for supplying a select signal to row lines of each block.

3. The liquid crystal display device according to claim 1, wherein the control signal from the display control section to the column line driver includes a switching control signal for controlling switching operation performed by the selector switch; and the switching control signal makes the select time of the data signal longer than the select time of the black signal display.

4. The liquid crystal display device according to claim 1, wherein the control signal from the display control section to the column line driver includes a switching control signal for controlling the switching operation performed by the selector switch; and the switching control signal makes the select time of the data signal and the select time of the black display signal equal to each other.

5. The liquid crystal display device according to claim 1, wherein the control signal from the display control section to the row line driver includes a discriminant signal for discriminating whether it is a black display signal supply period during which the black signal is supplied; and based on the discriminant signal, the row line drive supplies the select signal to the (n+m)th to (n+m+k−1) th row lines (m, k: a positive integer) during the black display signal supply period.

6. The liquid crystal display device according to claim 5, wherein the control signal from the display control section to the row line driver includes a scan start signal, and wherein the row line driver comprises:

a shift register having a plurality of latch circuits; and scan start signal supplying means for supplying the scan start signal to the first latch circuit of the shift register during a data signal supply period, and also supplying the scan start signal to continuous k latch circuits starting from the mth latch circuit of the shift register during a black display signal supply period.

7. The liquid crystal display device according to claim 6, wherein the scan start signal supplying means is enabled to change the latch circuit number "m" and the number of latch circuits "k" for the black display signal supply period.

8. The liquid crystal display device according to claim 7, further comprising:

supply control means for controlling the operation of the scan start signal supplying means, and the supply control means outputs a control signal for setting the latch circuit number "m" to the scan start signal supplying means based on a scan-start-position designating signal from external.

9. The liquid crystal display device according to claim 1, further comprising:

a signal-use reference power supply for setting a voltage of a data signal supplied from the column line driver, wherein the voltage of the signal-use reference power supply is changeable between the first display mode and the second display mode.

10. The liquid crystal display device according to claim 1, further comprising:

motion picture/still picture discriminating means for monitoring data of the same position on a screen based on an image signal derived from the display control section, thereby discriminating whether a picture based on the image signal is a motion picture or a still picture, and outputting a command signal representing a result of the discrimination to the display control section, wherein, the display control section selectively outputs the control signal for the first display mode or the control signal for the second display mode in response to the command signal.

11. The liquid crystal display device according to claim 1, further comprising:

a backlight for illuminating the display panel from its rear side; and backlight adjusting means for switching brightness of the backlight between the first display mode and the second display mode according to the command signal.

12. The liquid crystal display device according to claim 1, wherein the black display signal generating means is a black display signal use power supply, and the voltage of the black display signal use power supply is changeable.

* * * * *